US008613808B2

(12) United States Patent
Langan et al.

(10) Patent No.: US 8,613,808 B2
(45) Date of Patent: Dec. 24, 2013

(54) THERMAL DEPOSITION OF REACTIVE METAL OXIDE/ALUMINUM LAYERS AND DISPERSION STRENGTHENED ALUMINIDES MADE THEREFROM

(75) Inventors: Timothy Langan, Catonsville, MD (US); W. Mark Buchta, Ellicott City, MD (US); David M. Otterson, Washington, DC (US); Michael A. Riley, Towson, MD (US)

(73) Assignee: Surface Treatment Technologies, Inc., Halethorpe, MD (US)

( * ) Notice: Subject to any disclaimer, the term of this patent is extended or adjusted under 35 U.S.C. 154(b) by 1611 days.

(21) Appl. No.: 11/706,806

(22) Filed: Feb. 14, 2007

(65) Prior Publication Data

US 2008/0038149 A1 Feb. 14, 2008

Related U.S. Application Data

(60) Provisional application No. 60/773,044, filed on Feb. 14, 2006.

(51) Int. Cl.
*B21D 31/00* (2006.01)
*F02F 11/00* (2006.01)

(52) U.S. Cl.
USPC ..... 148/325; 72/379.2; 277/595

(58) Field of Classification Search
USPC ..... 420/591; 164/46
See application file for complete search history.

(56) References Cited

U.S. PATENT DOCUMENTS 3,726,643 A 4/1973 Merzhanov et al.
4,161,512 A 7/1979 Merzhanov et al.
4,431,448 A 2/1984 Merzhanov et al.
4,710,348 A 12/1987 Brupbacher et al.
4,783,379 A 11/1988 Wickersham et al.
4,836,982 A 6/1989 Brupbacher et al.
4,915,905 A 4/1990 Kampe et al.
4,917,964 A 4/1990 Moshier et al.
5,015,534 A 5/1991 Kampe et al.
5,266,132 A 11/1993 Danen et al.
5,490,911 A 2/1996 Makowiecki et al.
5,505,799 A 4/1996 Makowiecki
5,538,795 A 7/1996 Barbee, Jr. et al.
5,547,715 A 8/1996 Barbee, Jr. et al.

(Continued)

FOREIGN PATENT DOCUMENTS

GB 2 036 805 A 7/1980

OTHER PUBLICATIONS

Sampath et al., "Plasma Sprayed Ni-Al Coatings", Surface Engineering, 1989, vol. 5, No. 4, pp. 293-298.

(Continued)

*Primary Examiner* — Rebecca Lee
(74) *Attorney, Agent, or Firm* — Alan G. Towner, Esq.; Pietragallo Gordan Alfano Bosick & Raspanti, LLP

(57) ABSTRACT

Metal aluminides are formed by an initial thermal deposition process which forms an intermediary material comprising elemental aluminum and another elemental metal, as well as an oxide of the other metal. The thermally formed intermediary material is subsequently heated to initiate an exothermic reaction which forms the metal aluminide material. The reaction may be initiated by localized or bulk heating of the intermediary material, and may involve reaction between the aluminum and elemental metal as well as a thermite reaction between the aluminum and the metal oxide. The resultant metal aluminide material may be substantially fully dense and may contain oxide strengthening precipitates such as aluminum oxide.

31 Claims, 28 Drawing Sheets

(56) References Cited

U.S. PATENT DOCUMENTS

| | | | |
|---|---|---|---|
| 5,606,146 | A | 2/1997 | Danen et al. |
| 6,123,999 | A | 9/2000 | Felix et al. |
| 6,152,040 | A | 11/2000 | Riley et al. |
| 6,534,194 | B2 | 3/2003 | Weihs et al. |
| 6,596,101 | B2 | 7/2003 | Weihs et al. |
| 6,736,942 | B2 | 5/2004 | Weihs et al. |
| 6,863,992 | B2 | 3/2005 | Weihs et al. |
| 6,991,855 | B2 | 1/2006 | Weihs et al. |
| 6,991,856 | B2 | 1/2006 | Weihs et al. |
| 7,005,404 | B2 | 2/2006 | He |
| 7,278,353 | B2 | 10/2007 | Langan et al. |
| 7,278,354 | B1 | 10/2007 | Langan et al. |
| 7,361,412 | B2 | 4/2008 | Wang et al. |
| 2001/0046597 | A1 | 11/2001 | Weihs et al. |
| 2002/0182436 | A1 | 12/2002 | Weihs et al. |
| 2003/0012678 | A1 | 1/2003 | Sherman |
| 2003/0164289 | A1 | 9/2003 | Weihs et al. |
| 2004/0060625 | A1 | 4/2004 | Barbee, Jr. et al. |
| 2005/0051607 | A1 | 3/2005 | Wang et al. |
| 2005/0082343 | A1 | 4/2005 | Wang et al. |
| 2005/0100756 | A1 | 5/2005 | Langan et al. |
| 2005/0136270 | A1 | 6/2005 | Besnoin et al. |
| 2006/0068179 | A1 | 3/2006 | Weihs et al. |
| 2008/0173206 | A1 | 7/2008 | Langan et al. |

OTHER PUBLICATIONS

Zeng et al., "Microstructural Characterization of Ni3Al Processed by Reactive Atomization and Deposition", Metallurgical and Materials Transactions A: Physical Metallurgy and Materials Science, ASM International, Apr. 1995, vol. 26A, No. 4, pp. 817-827.

Chakraborty et al., "A study on the preparation of iron aluminum based intermetallic alloy by aluminothermic smelting technique", Journal of Alloys and Compounds, 1998, vol. 280, No. 1-2, pp. 255-261.

Hu et al., "Synthesis and Characterization of Nanocrystalline Iron Aluminide Intermetallic Compounds", Materials Transactions, 2003, vol. 44, No. 12, pp. 2678-2687.

MAG = 200X 100μm EHT = 15.00 kV WD = 9 mm SIGNAL A = QBSD PHOTO NO. = 3431

MAG = 200X 200μm EHT = 15.00 kV WD = 8 mm SIGNAL A = QBSD PHOTO NO. = 3438

MAG = 5.00 K X EHT = 15.00 kV SIGNAL A = QBSD
WD = 9 mm PHOTO NO. = 3422
10 μm
P-0191604-2_02.TIF

MAG = 5.00 K X EHT = 15.00 kV SIGNAL A = QBSD
WD = 8 mm PHOTO NO. = 3440
10 μm
P-0191604-2_03.TIF

MAG = 500 X EHT = 15.00 kV SIGNAL A = QBSD
WD = 9 mm PHOTO NO. = 3425
100 μm
P-0191604-2_05.TIF

MAG = 500 X EHT = 15.00 kV SIGNAL A = QBSD
WD = 8 mm PHOTO NO. = 3444
100 μm
P-0191604-2-r_07.TIF

MAG = 200X 100μm EHT = 15.00 kV WD = 7 mm SIGNAL A = QBSD PHOTO NO. = 3371

MAG = 200X 100μm EHT = 30.00 kV WD = 12 mm SIGNAL A = QBSD PHOTO NO. = 2730

THERMAL DEPOSITION OF REACTIVE METAL OXIDE/ALUMINUM LAYERS AND DISPERSION STRENGTHENED ALUMINIDES MADE THEREFROM

CROSS-REFERENCE TO RELATED APPLICATION

This application claims the benefit of U.S. Provisional Application No. 60/773,044 filed Feb. 14, 2006, which is incorporated herein by reference.

GOVERNMENT CONTRACT

The United States Government has certain rights to this invention pursuant to Contract No. DASG60-03-C-0025 awarded by the U.S. Army Space and Missile Defense Command and Contract No. F08630-03-C-0022 awarded by the U.S. Air Force.

BACKGROUND INFORMATION

Nickel aluminum alloys (nickel aluminides) are corrosion resistant at elevated temperatures. Reaction synthesis can be used to form these alloys from a mixture of fine elemental powders. In this technique, a powder with the desired composition is mixed in a ball mill and then pressed into a die. The pressed powder is then heated to initiate an exothermic reaction that forms nickel aluminide. The resulting material is stronger and lighter than stainless steel. However, the material never becomes fully molten in this processing technique. This traps porosity in the microstructure that can reduce the overall strength of the material. Furthermore, the resulting alloy can retain some of the microstructural features of the pre-reacted form.

Thermal spray processing is the deposition of molten or semi-molten material onto a substrate to create a coating for modifying properties, for dimensional restoration on a part or for producing a three dimensional form. The material being deposited typically comes from a powder, rod or wire feedstock and is heated as it is accelerated towards a substrate by a hot jet of combusting or plasma gas. Upon impact, the molten droplets spread to from splats. A coating or solid object is formed as layer upon layer of these splats deposit on top of already deposited droplets.

SUMMARY OF THE INVENTION

A reaction synthesis path is described for the production of reinforced aluminides, such as nickel aluminides. Although nickel aluminides are primarily described herein, other intermetallics may be produced in accordance with the present invention. For example, other aluminides such as copper aluminides, titanium aluminides, iron aluminides, tungsten aluminides, and the like may be produced. The synthesis technique uses thermal spray technology as a powder consolidation process to form a precursor composite material. The precursor or intermediary material is produced by thermally spraying a precursor metal and aluminum in the presence of oxygen in such a manner that the precursor metal is partially oxidized in flight. The resultant intermediary material comprises the precursor metal, an oxide of the precursor metal, and aluminum. For example, the intermediary material may comprise Ni, NiO and Al, with the NiO forming a surface layer on the Ni. Porosity of the intermediary material is minimized and the concentration of metal oxides is controlled by manipulating the parameters used to create the composite.

The intermediary precursor composite subsequently undergoes a self-sustaining reaction when sufficient thermal energy is applied. The temperature achieved during this reaction is determined by the concentration of metal oxides in the reactive precursor. The low porosity and macroscopic homogeneity of the precursor composite give it unique thermal properties during the reaction that allow the entire reacting body to become fully molten. In this fully molten state the material can be cast by pouring it into a mold. A precipitate of alumina microspheres may form from the melt, creating a reinforcing mechanism. Further cooling creates a dispersion strengthened nickel aluminide alloy.

Benefits of the present invention include: a superior reactive precursor form with less porosity, better particle to particle contact and controllable oxide content that controls reaction dynamics; a superior alloying reaction with better heat transfer, hotter reaction and achievement of a fully molten state; and a superior structure with full consolidation, strengthening mechanism provided by a dispersion of alumina microspheres and controllable concentration of microspheres.

An aspect of the present invention is to provide a method of making a reactive material comprising thermally spraying a precursor metal and aluminum in the presence of oxygen to partially oxidize the precursor metal in flight and to produce a reactive intermediary material comprising the precursor metal, an oxide of the precursor metal, and the aluminum.

Another aspect of the present invention is to provide a method of making a metal aluminide material comprising thermally spraying precursor metal and aluminum in the presence of oxygen to produce an intermediary material comprising the precursor metal, an oxide of the precursor metal, and aluminum, and initiating a reaction of the intermediary material to form the metal aluminide material.

A further aspect of the present invention is to provide a method of making a metal aluminide material comprising heating an intermediary material comprising thermally sprayed elemental aluminum, at least one other elemental metal, and an oxide of the at least one other elemental metal, to initiate an exothermic reaction which forms the metal aluminide material.

Another aspect of the present invention is to provide a thermally sprayed intermediary material comprising elemental aluminum, at least one other elemental metal capable of forming a metal aluminide with the aluminum, and an oxide of the at least one other elemental metal.

A further aspect of the present invention is to provide a metal aluminide material comprising a reaction product of an intermediary material comprising thermally sprayed elemental aluminum, at least one other elemental metal capable of forming the metal aluminide, and an oxide of the at least one other elemental metal.

These and other aspects of the present invention will be more apparent from the following description.

DETAILED DESCRIPTION

Figure 1:
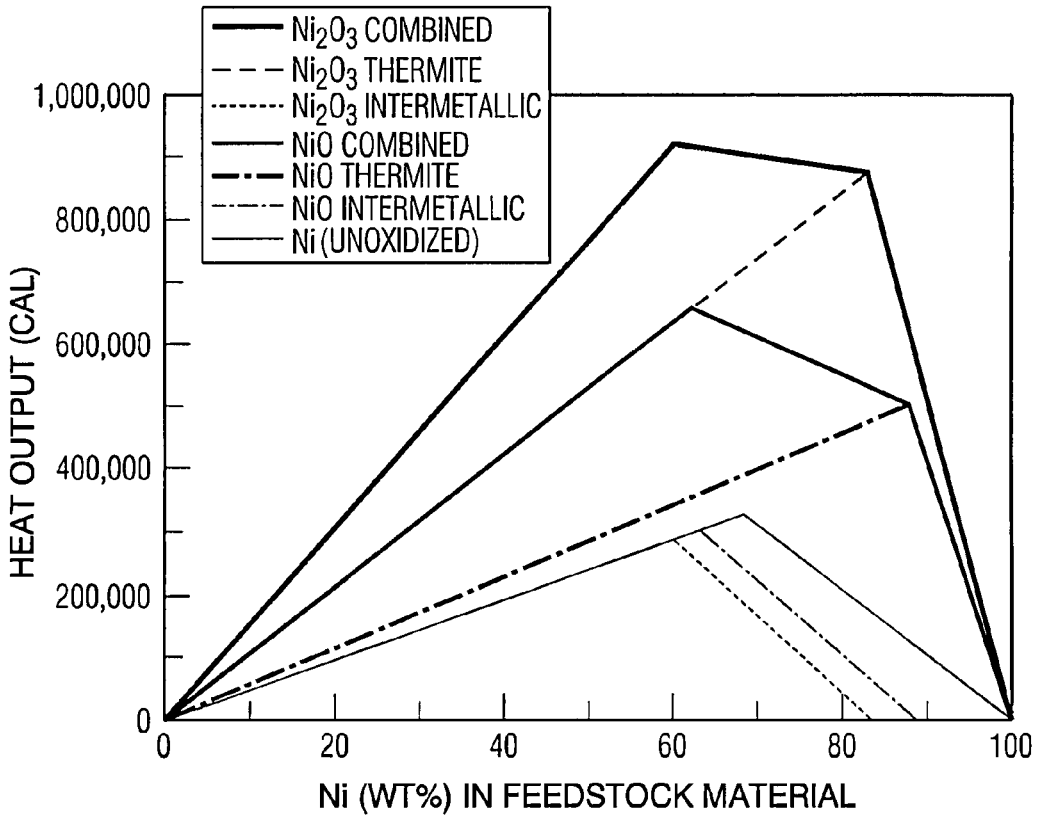
FIG. 1 illustrates reaction energies as a function of initial Ni and Al composition during the formation of nickel aluminides.

An embodiment of the current invention improves on nickel aluminides created using the pressed powder metallurgy technique by using an innovative powder consolidation process. This process changes the chemistry of the reaction by introducing nickel oxides (NiO) or other oxides into the reactive intermediary. This precursor composite is also less porous than the reactive material created in the pressed powder technique. NiO reacts with the elemental Al through a thermite reaction. This increases the total amount of thermal energy released during the reaction and creates a faster overall reaction. This allows the component metals to fully melt during the alloying reaction. Furthermore, the reduced porosity in the reactive intermediary reduces the porosity in the final alloy providing it with additional strength.

The NiO—Ni—Al reactive intermediary is created from a mixture of Ni and Al powders using thermal spray processing. As used herein, the term "thermal spray" includes processes such as flame spraying, plasma arc spraying, electric arc spraying, high velocity oxy-fuel (HVOF) deposition cold spraying, detonation gun deposition and super detonation gun deposition, as well as others known to those skilled in the art. Source materials for the thermal spray process include powders, wires and rods of material that are fed into a flame where they are partially or fully melted. When wires or rods are used as the feed materials, molten stock is stripped from the end of the wire or rod and atomized by a high velocity stream of compressed air or other gas that propels the material onto a substrate or workpiece. When powders are used as the feed materials, they may be metered by a powder feeder or hopper into a compressed air or gas stream that suspends and delivers the material to the flame where it is heated to a molten or semi-molten state and propelled to the substrate or workpiece. A bond may be produced upon impact of the thermally sprayed reactive components on the substrate. As the molten or semi-molten plastic-like particles impinge on the substrate, several bonding mechanisms are possible. Mechanical bonding may occur when the particles splatter on the substrate. The particles may thus mechanically interlock with other deposited particles. In addition, localized diffusion or limited alloying may occur between the adjacent thermally sprayed materials. In addition, some bonding may occur by means of Van der Waals forces.

In one embodiment, stoichiometrically equal amounts of Ni and Al powders are mixed to create a feedstock powder. This mixed powder is then fed via a Sulzer-Metco 9MP powder into a Sulzer-Metco 9MB plasma spray torch. The high temperature plasma melts the Ni and Al powders and propels them towards a substrate. Depending on the processing conditions that are selected, a controllable amount of the Ni material is oxidized into a mixed nickel oxide ($Ni_xO_y$) in-flight, Eq. 1.

$$Ni+Al+O_2 \rightarrow Ni_xO_y+Al+Ni \quad \text{Eq. 1}$$

The molten metal particles impinge on the substrate where they rapidly cool and solidify. This is an important step in the formation of the reactive intermediary because it prevents the metals from prematurely reacting.

Reaction synthesis begins when any portion of this precursor composite is heated to the eutectic NiAl melting temperature (625° C.). At this point, two simultaneous, complimentary reactions will occur. The more energetic reaction is a thermite reaction that occurs between the nickel oxide and the aluminum. The term "thermite" is often used to refer to a mixture of pure aluminum and ferric oxide that undergoes a highly exothermic reaction to form alumina and molten iron:

$$2Al+Fe_2O_3 \rightarrow Al_2O_3+2Fe \ \Delta H=-203 \text{ kcal} \quad \text{Eq. 2}$$

However, the term thermite actually refers to any reaction between a metal oxide (oxidizer) and elemental aluminum. These reactions are difficult to initiate but will proceed rapidly to completion and release a high quantity of thermal energy in the process. In fact, so much heat is generated by these reactions that the metallic reaction products are molten at the end of the reaction. The nickel oxide/Al thermite reaction creates elemental nickel and alumina ($Al_2O_3$) as reaction products, Eq. 3.

$$2Al+3NiO \rightarrow Al_2O_3+3Ni \quad \text{Eq. 3}$$

The $Al_2O_3$ forms a precipitate that strengthens the alloy and the Ni is available to participate in the intermetallic Ni—Al reaction.

The reaction that then occurs between Ni and Al, is an intermetallic self-propagating high temperature synthesis reaction (SHS). SHS reactions occur between two metals and generate enough heat to sustain their own propagation. That is to say, that once initiated by heat, these reactions will proceed until one of the reactants is completely consumed. In the current invention, elemental Ni and Al combine to form a nickel aluminide ($Ni_xAl_y$).

$$Ni+Al \rightarrow NiAl \quad \text{Eq. 4}$$

When acting by itself, the SHS reaction releases enough heat to cause the reacting metals to glow red hot but it does not completely melt the metals. As such, the composite is able to retain its shape during the reaction.

The combined energies of the complimentary reactions allow the material to achieve a fully molten state. A comparison of the reaction energies is depicted in FIG. 1. This reduces trapped porosity by allowing the material to fully consolidate. While it is fully molten, it is also possible to pour this alloy into a mold to achieve a desired shape. This allows more complex geometries to be achieved than are possible using the pressed powder synthesis technique. Finally, the synthesis reaction creates an alumina ($Al_2O_3$) precipitate that nucleates as microspheres that are dispersed throughout the alloy's microstructure. These spheres give the alloy additional strength.

Figure 2:
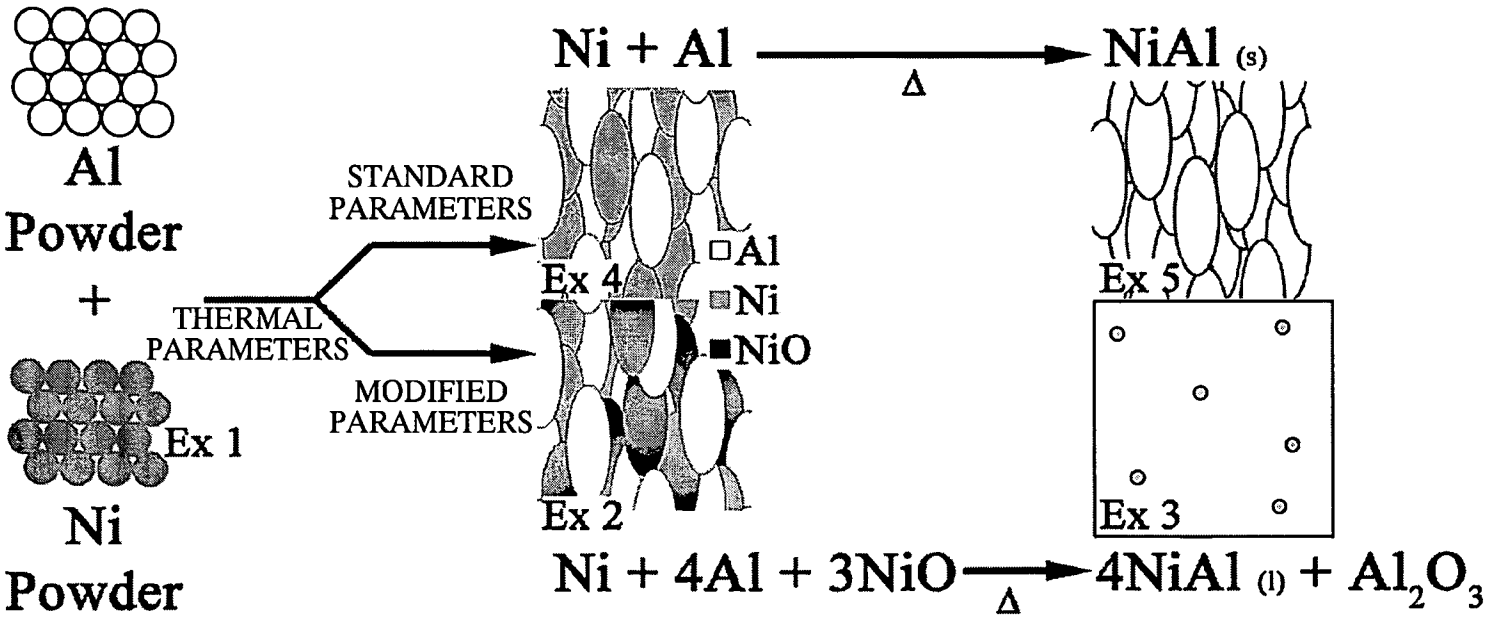
FIG. 2 is a schematic diagram illustrating an embodiment of the present invention.

Several examples will be used to demonstrate that the chemical composition of the intermediary reactive composite can be controlled to determine the energy released during the synthesis reaction. These changes affect the microstructure of the nickel aluminide and the concentration of the alumina microspheres in the alloy. FIG. 2 shows a representative summary of the differences between these examples.

The X-ray diffaction (XRD) measurements were performed on loose powders or on the polished surface of each specimen using a Panalytical X'Pert Pro system with a 240 mm radius in Bragg-Brentano (theta-2theta) mode using Cu $K_\alpha$ radiation with an operating voltage of 45 kV and current of 40 mA. An incident beam divergence of 0.5° was used and x-rays were detected with a miniproportional counter mounted behind a Cu $K_\alpha$ monocromator (Panalytical PW3123/10) wth the receiving slit was set at 0.3 mm. Continuous scans were performed from 30° to 100° with a 0.03° step size and a counting time of 4 seconds/step.

Scanning electron microscopy (SEM) was performed using a LEO 1530VP Field Emission Scanning Electron Microscope (FESEM), with an EDS Microanalysis System (EDAX Phoenix). Images were collected using secondary and back-scattered electron (BSE) detectors. The operating voltage and current are listed in the images themselves.

Example 1

70 (wt %) Ni 30 (wt %) Al Mixed Powder

Figure 3:
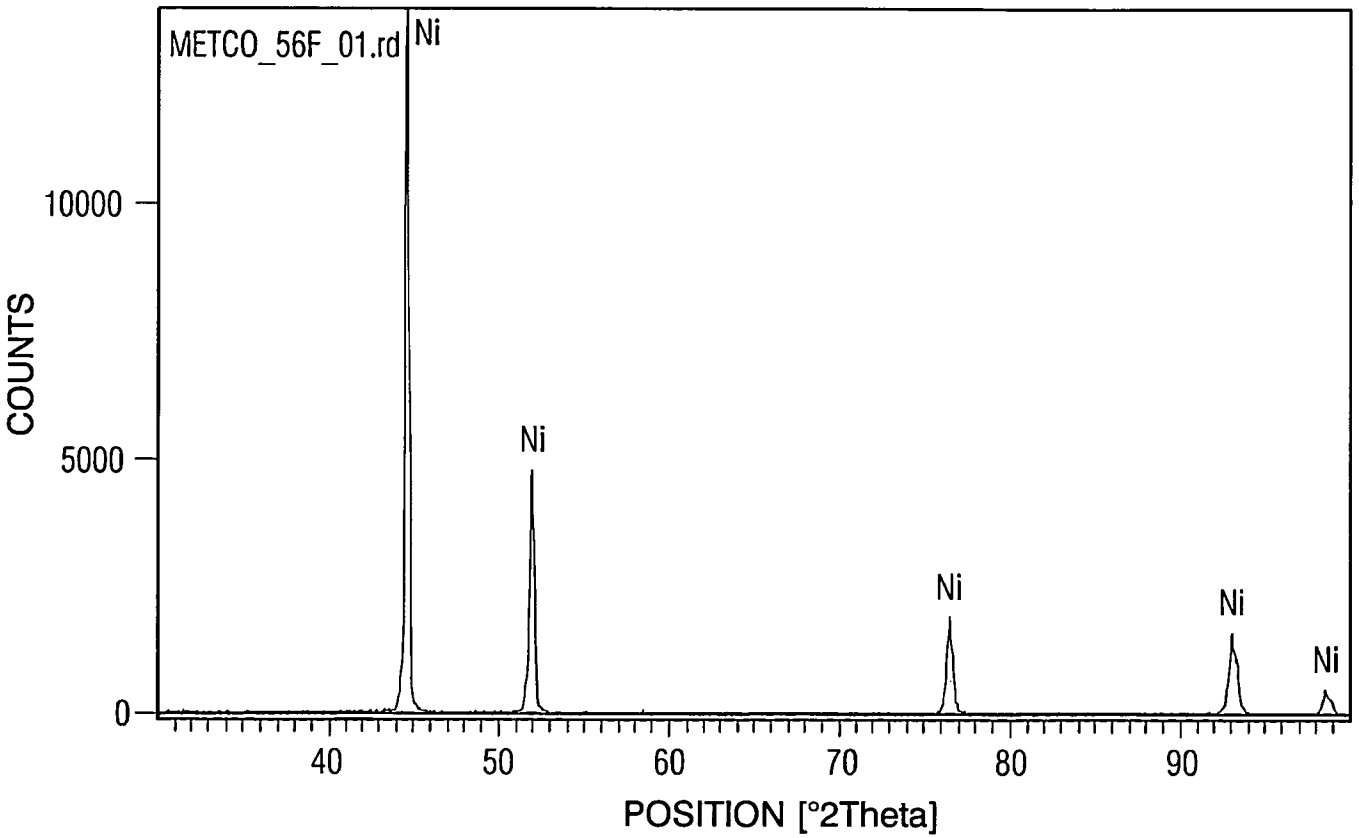
FIG. 3 is an XRD spectrum for Ni feedstock material.

Example 1 is a stoichiometric mixture of Ni and Al powders. Both powders are commercially available thermal spray grade powders. The x-ray diffractogram demonstrates that the Ni powder (Sulzer Metco Ni 56F) was oxide free, FIG. 3.

Example 2

Metastable Intermediary Material with High Oxide Content

Thermal spray technology is then used to consolidate the stoichiometric Ni—Al powder mixture of Example 1 into a reactive composite material. This composite is dense and is capable of bearing loads in excess of 12 ksi. Process parameters were selected to create a composite with a high nickel oxide (NiO) concentration. Creating a composite with a high concentration of NiO allows it to react through an energetic thermite reaction. This allows a higher temperature to be achieved during the reaction.

Figure 4:
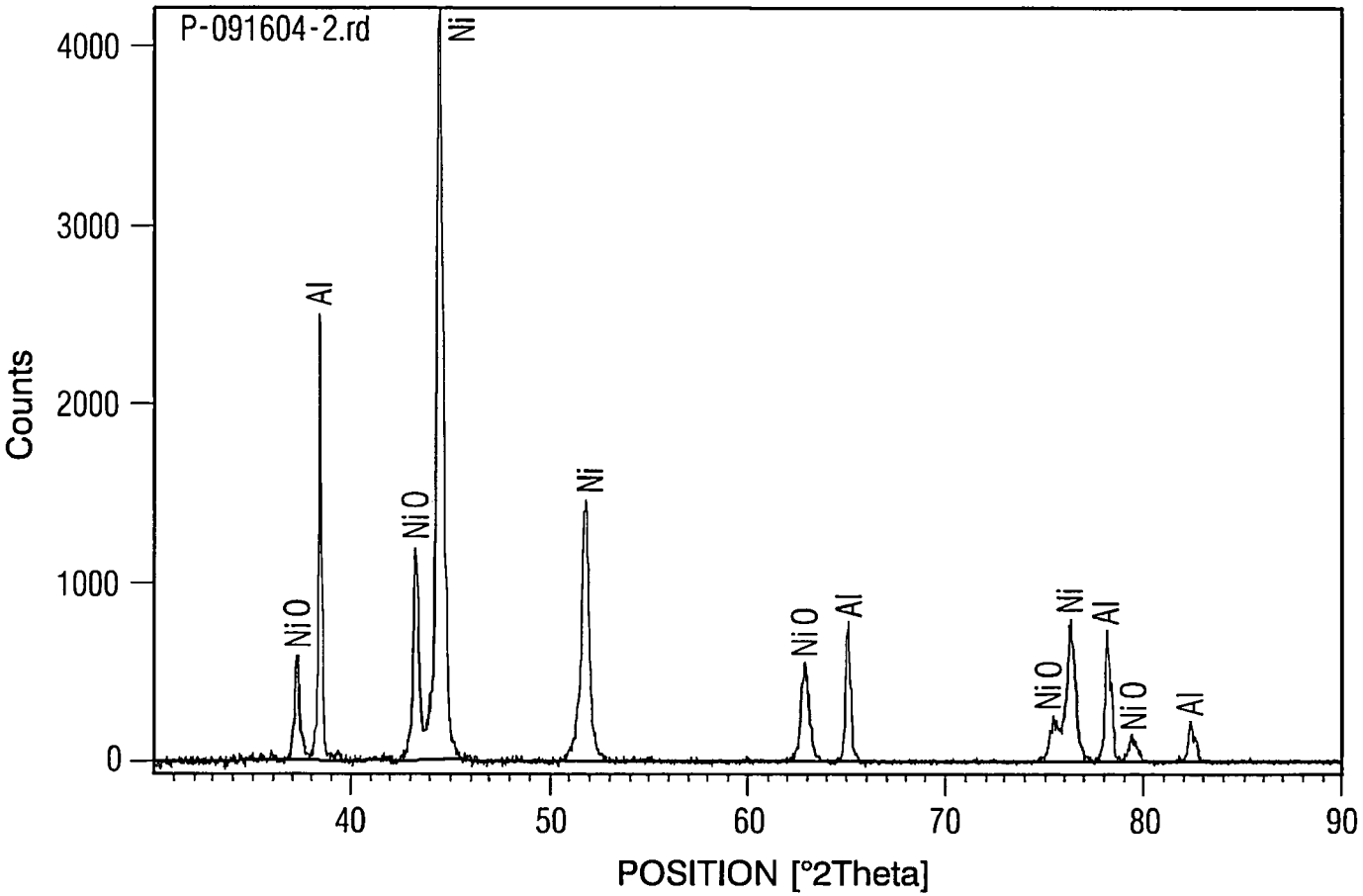
FIG. 4 is an XRD spectrum for a thermally sprayed metastable intermediary material comprising elemental Al, elemental Ni and NiO in accordance with an embodiment of the present invention.
Figure 5:
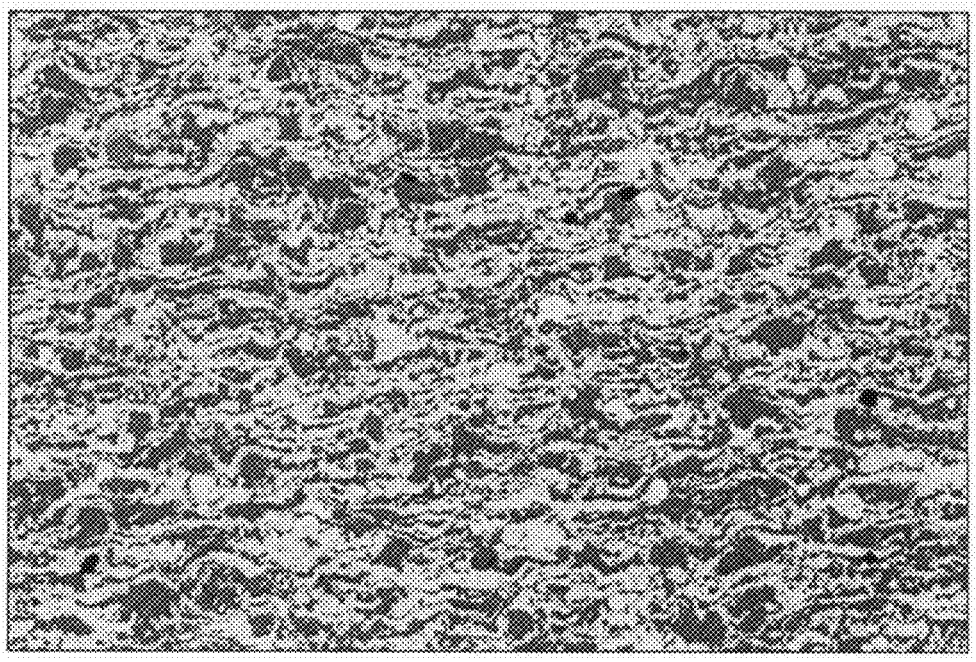
FIG. 5 is a back-scattered SEM image (200×) for a thermally sprayed metastable intermediary material comprising elemental Al, elemental Ni and NiO in accordance with an embodiment of the present invention.

The XRD spectrum obtained from the high oxide content composite shows that the primary phases present are elemental Al, elemental Ni and nickel oxide (NiO), FIG. 4. SEM in back-scattered electron mode coupled with energy dispersive x-ray spectroscopy (EDS) was used to observe the distribution of the aluminum and nickel phases identified by XRD. The low magnification image (200×), FIG. 5, shows that material is fully consolidated and consists mainly of spheres and veins of pure aluminum (appearing dark grey) interspersed with similar spheres and veins which are near white to light grey in appearance. These lighter regions are a mixture of pure nickel (appearing near white in the micrograph) and NiO phase (appearing light grey). This is consistent with XRD results. A mixed Al—Ni phase (appearing grey) can also be observed in some regions. The largest nickel spheres are approximately 40 μm in diameter; the largest aluminum spheres/particles are larger, ~60-80 μm.

Figure 6:
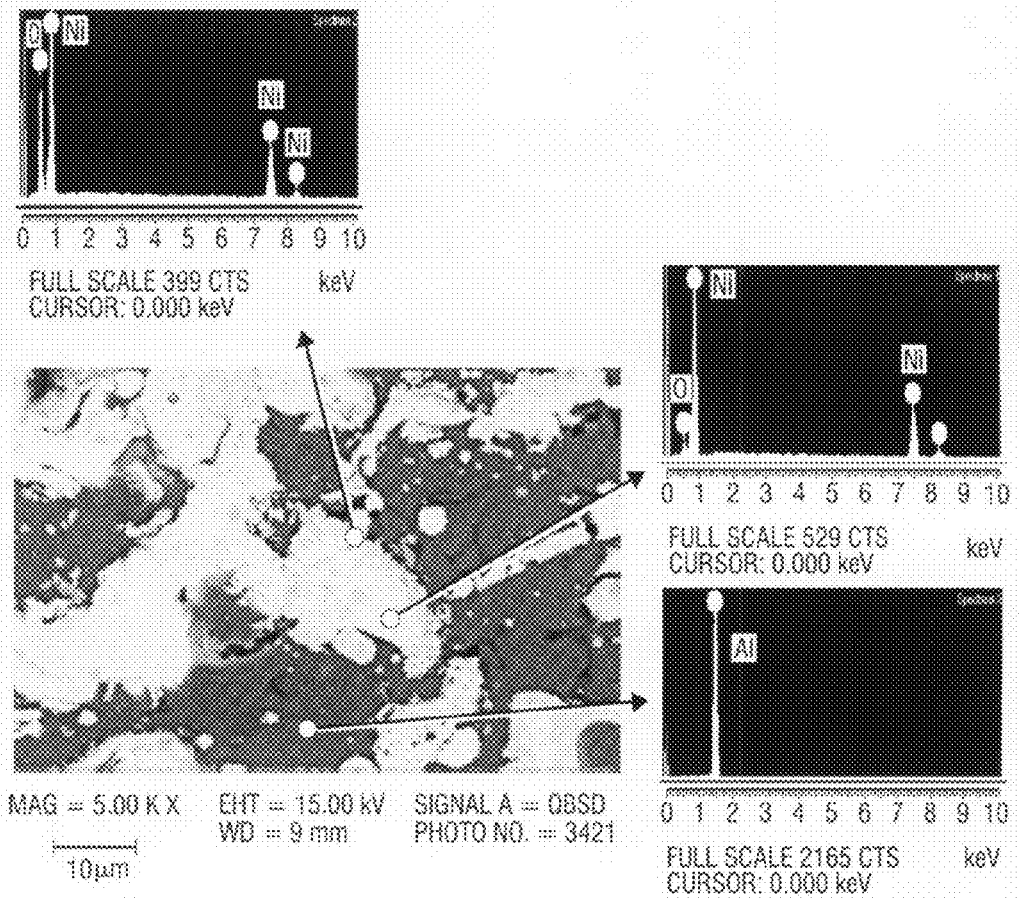
FIG. 6 is a back-scattered SEM image (5000×) and spot analyses by EDS for a thermally sprayed metastable intermediary material comprising elemental Al, elemental Ni and NiO in accordance with an embodiment of the present invention.

These phase identifications are supported by higher magnification SEM/EDS spot analyses shown in FIG. 6. Here, the pure nickel, pure aluminum, and NiO can be clearly identified. In some regions, an Al—Ni alloy is observed, appearing lighter than the Al-rich phase in FIG. 3, but darker than the NiO. Although such isolated Ni—Al regions are observed throughout the specimen, no distinct intermetallic phase (e.g., $Al_3Ni$, AlNi) was observed in the XRD data.

Together, these results demonstrate that a significant portion of the Ni precursor material is converted to NiO in the reactive composite. Furthermore, only a small volume fraction of the precursor material reacts to form nickel aluminides during the formation of this intermediary composite.

Example 3

$Ni_xAl_y$ Strengthened by a Dispersion of Alumina Microspheres

Figure 7:
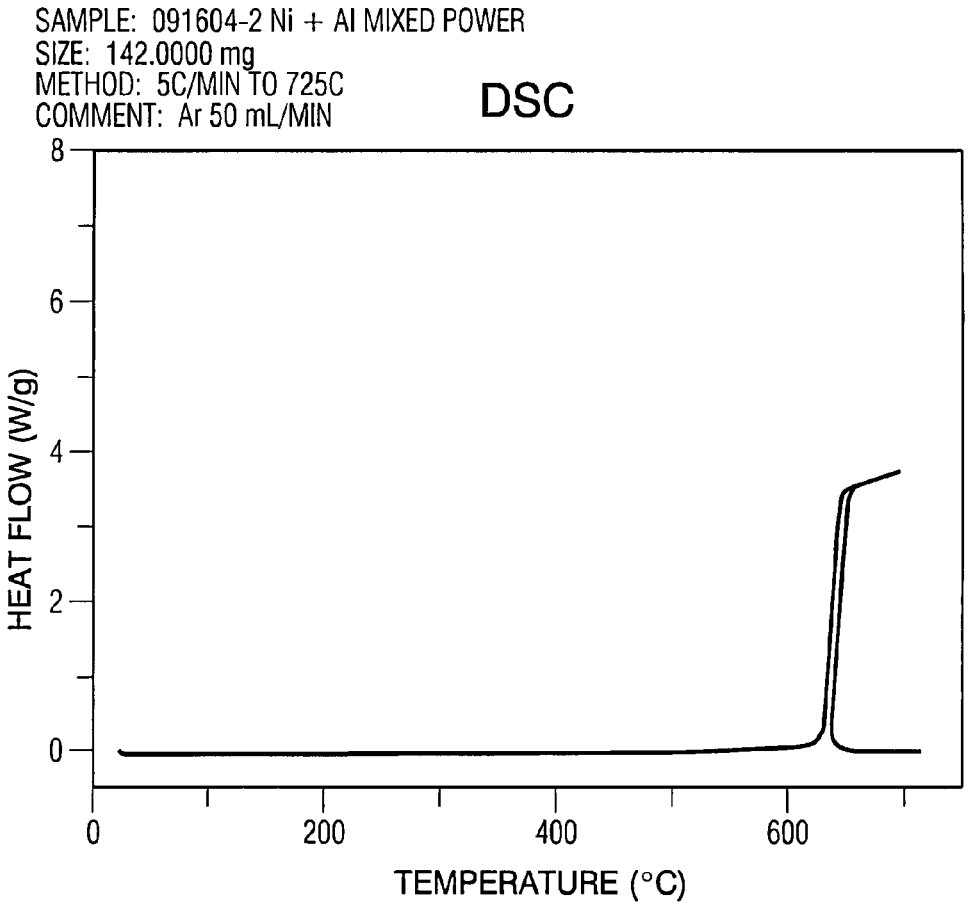
FIG. 7 is a DSC trace of an exothermic reaction that occurs upon heating of a reactive intermediary material comprising elemental Al, elemental Ni and NiO in accordance with an embodiment of the present invention.

Heat is then applied to the reactive composites of Example 2 to initiate a self-sustaining exothermic reaction. As the DSC in FIG. 7 shows, this reaction initiates at 625° C. and is more energetic than the Ni—Al reaction that occurs between the mixed powders. This allows a fully molten state to be achieved because the reaction provides sufficient heat to melt the reacting species. The molten material is free flowing and can be readily cast in a mold. As the material cools, alumina ($Al_2O_3$) precipitates from the melt to form a dispersion of reinforcing microspheres in a nickel alumide ($Ni_xAl_y$) matrix phase.

Figure 8:
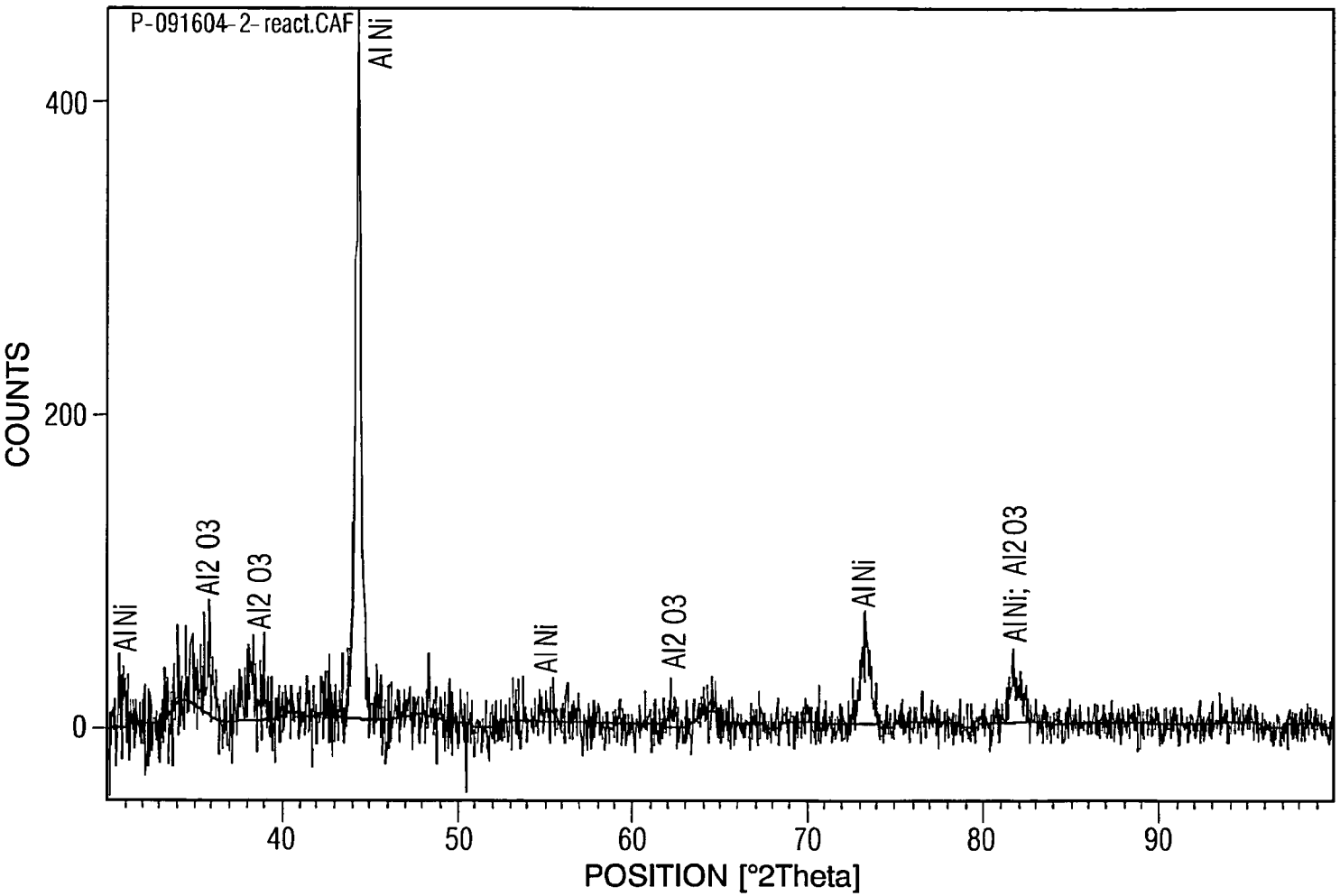
FIG. 8 shows XRD data for a dispersion strengthened $Ni_xAl_y$ material corresponding to the reaction product of the intermediary material in accordance with an embodiment of the present invention.

The XRD pattern obtained from this alloy is dominated by an Al—Ni alloy of ~1:1 ratio and smaller peaks of alumina ($Al_2O_3$), FIG. 8. The reflections of the initial aluminum, nickel, and NiO phases that had been present in the intermediary material are absent in this spectrum. This indicates that these phases are completely consumed in the reaction.

Figure 9:
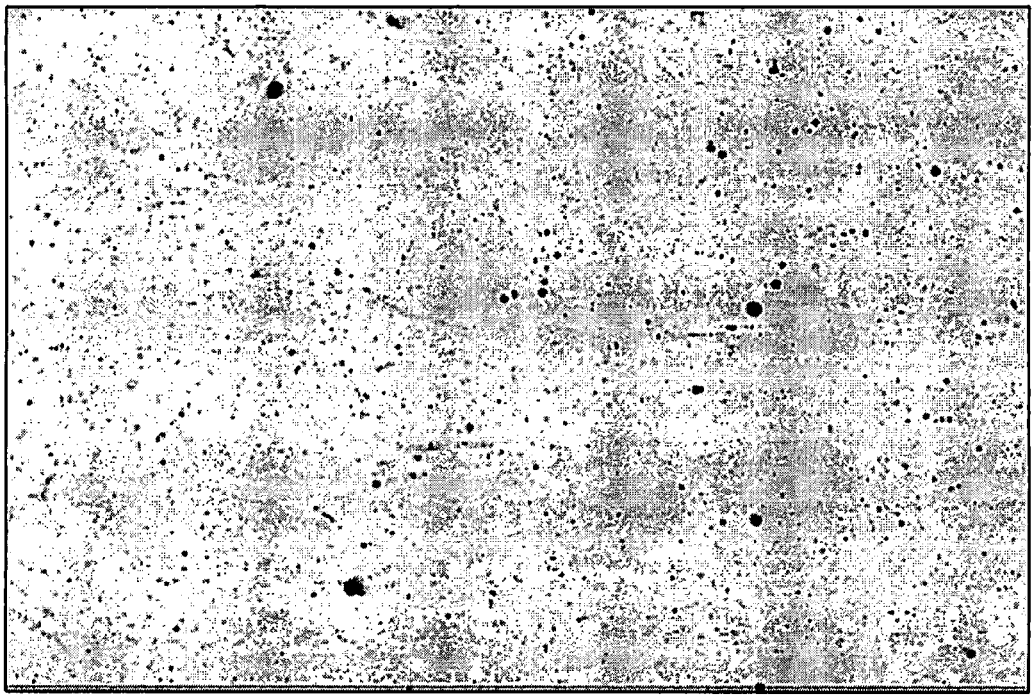
FIG. 9 is a back-scattered SEM image (200×) for a dispersion strengthened $Ni_xAl_y$ material corresponding to the reaction product of the intermediary material in accordance with an embodiment of the present invention.
Figure 10:
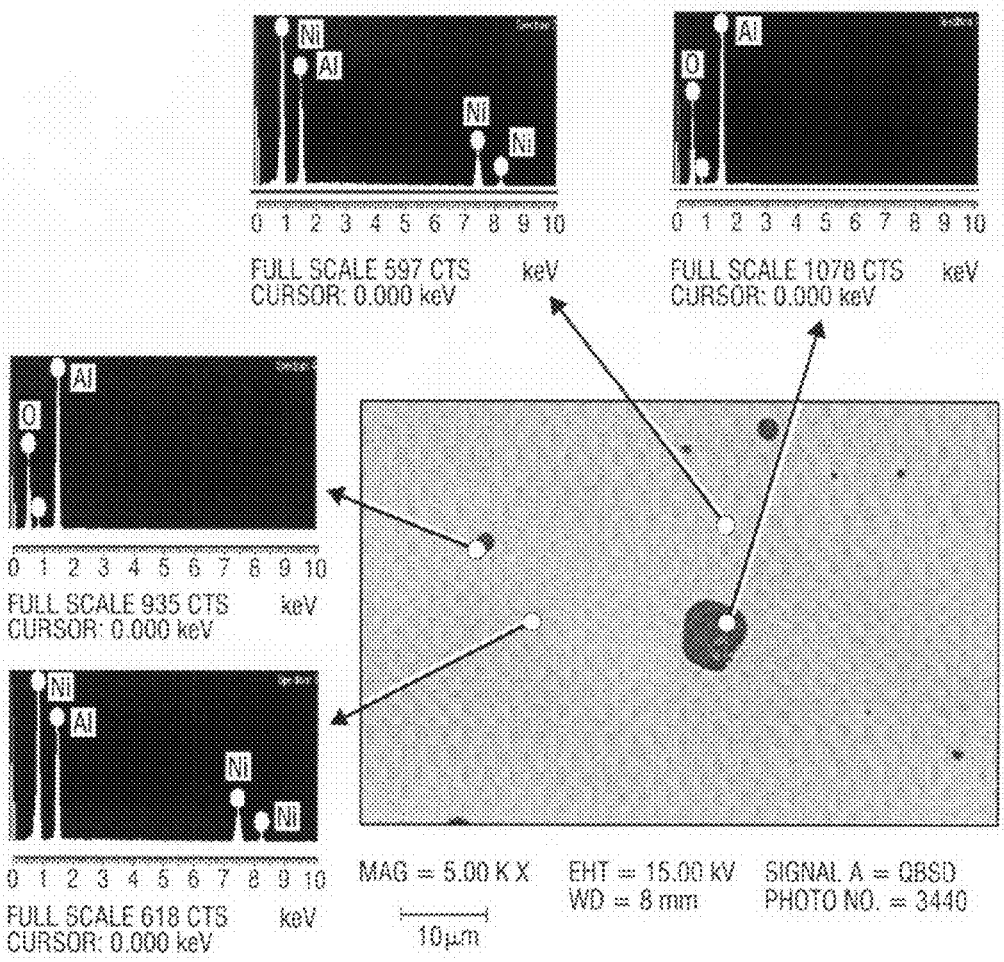
FIG. 10 is a back-scattered SEM image (5000×) for EDS spot analysis for a dispersion strengthened $Ni_xAl_y$ material corresponding to the reaction product of the intermediary material in accordance with an embodiment of the present invention.
Figure 11:
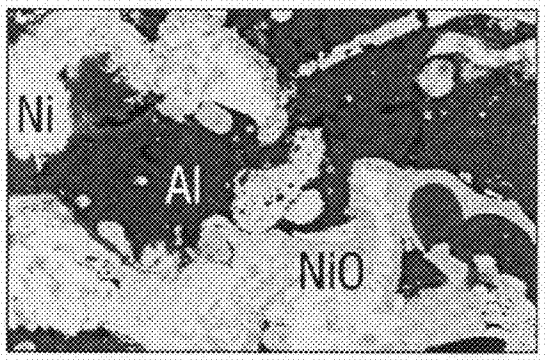
FIG. 11 shows BSE-SEM images of morphological change between the as-sprayed metastable intermediary material (left) and the reacted dispersion strengthened $Ni_xAl_y$ material (right) at high magnification (top) and low magnification (bottom).
Figure 11:
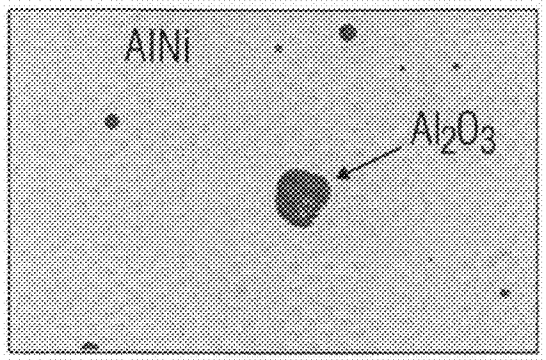
Figure 11:
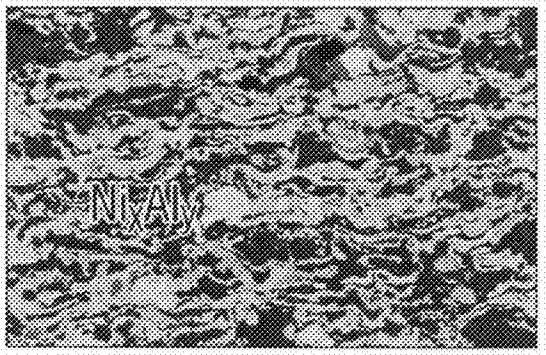
Figure 11:
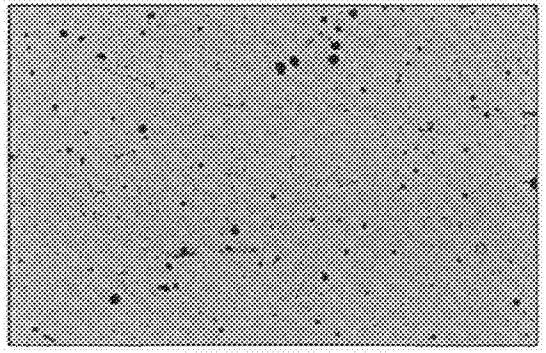

The low magnification BSE-SEM image in FIG. 9 is dominated by a light grey field interspersed by small spheres of a darker grey shaded phase. It is a fully consolidated material whose microstructure bears no resemblance to the reactive precursor material. The EDS shown in FIG. 10 demonstrates that the dominant phase is a nickel aluminide phase the distribution of grey spheres is $Al_2O_3$. These results are consistent with the XRD results and both indicate that the reacting Al, Ni and NiO species are completely consumed in the reaction. FIG. 11 presents high and low magnification images that show the microstructural changes that occur when the reactive intermediary composite is reacted to form the alumina reinforced nickel aluminide composite.

Example 4

Metastable Intermediary Material with Low Oxide Content

Figure 12:
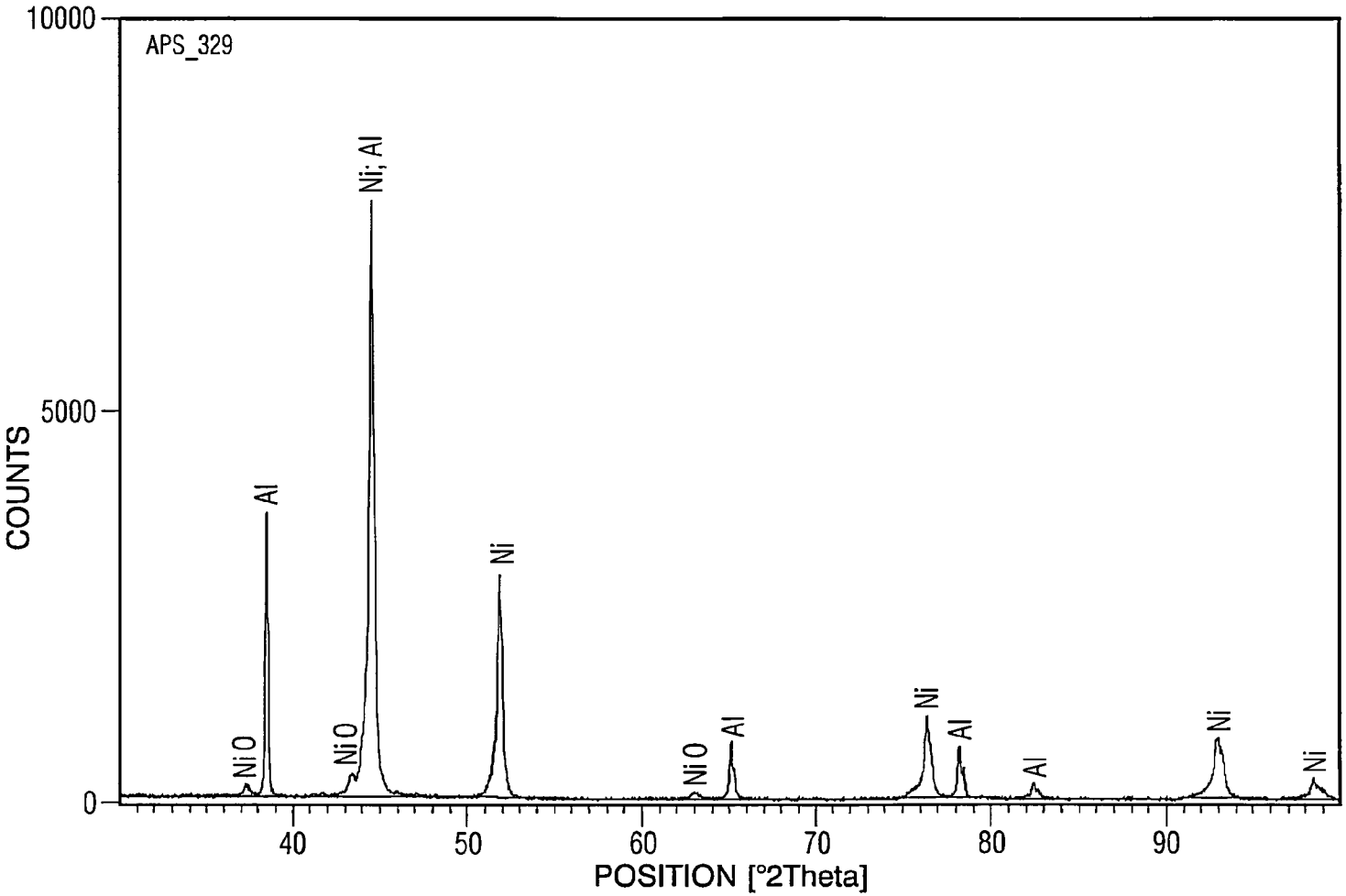
FIG. 12 shows XRD data for a low oxide content reactive precursor.
Figure 13:
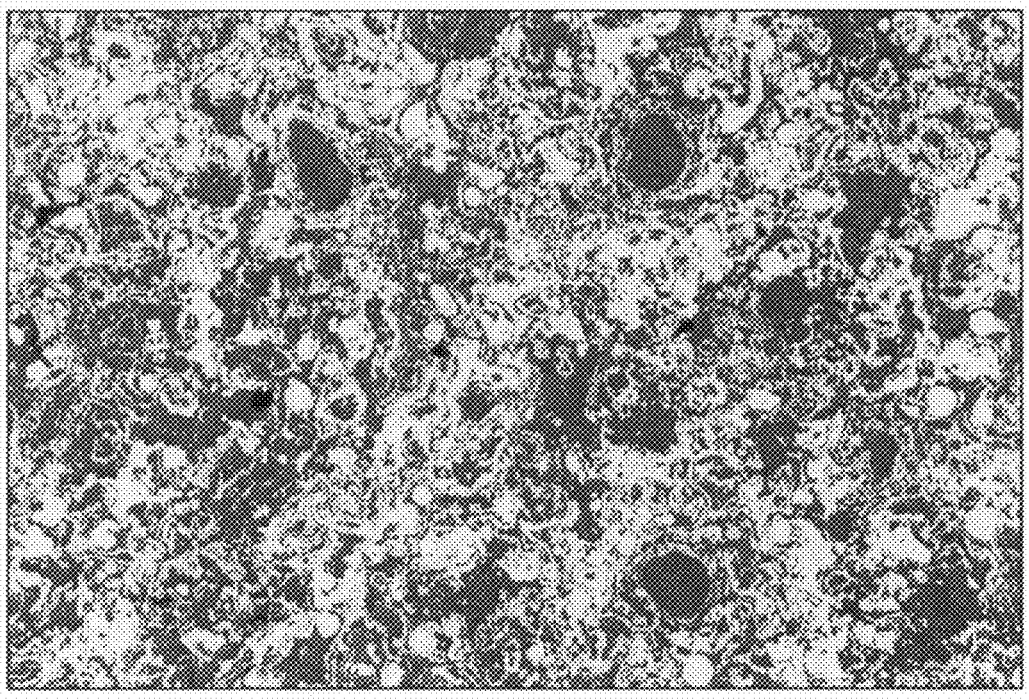
FIG. 13 is a back-scattered SEM image (200×) for a low oxide content thermally sprayed metastable intermediary material comprising elemental Al, elemental Ni and relatively low amounts of NiO in accordance with an embodiment of the present invention.
Figure 14:
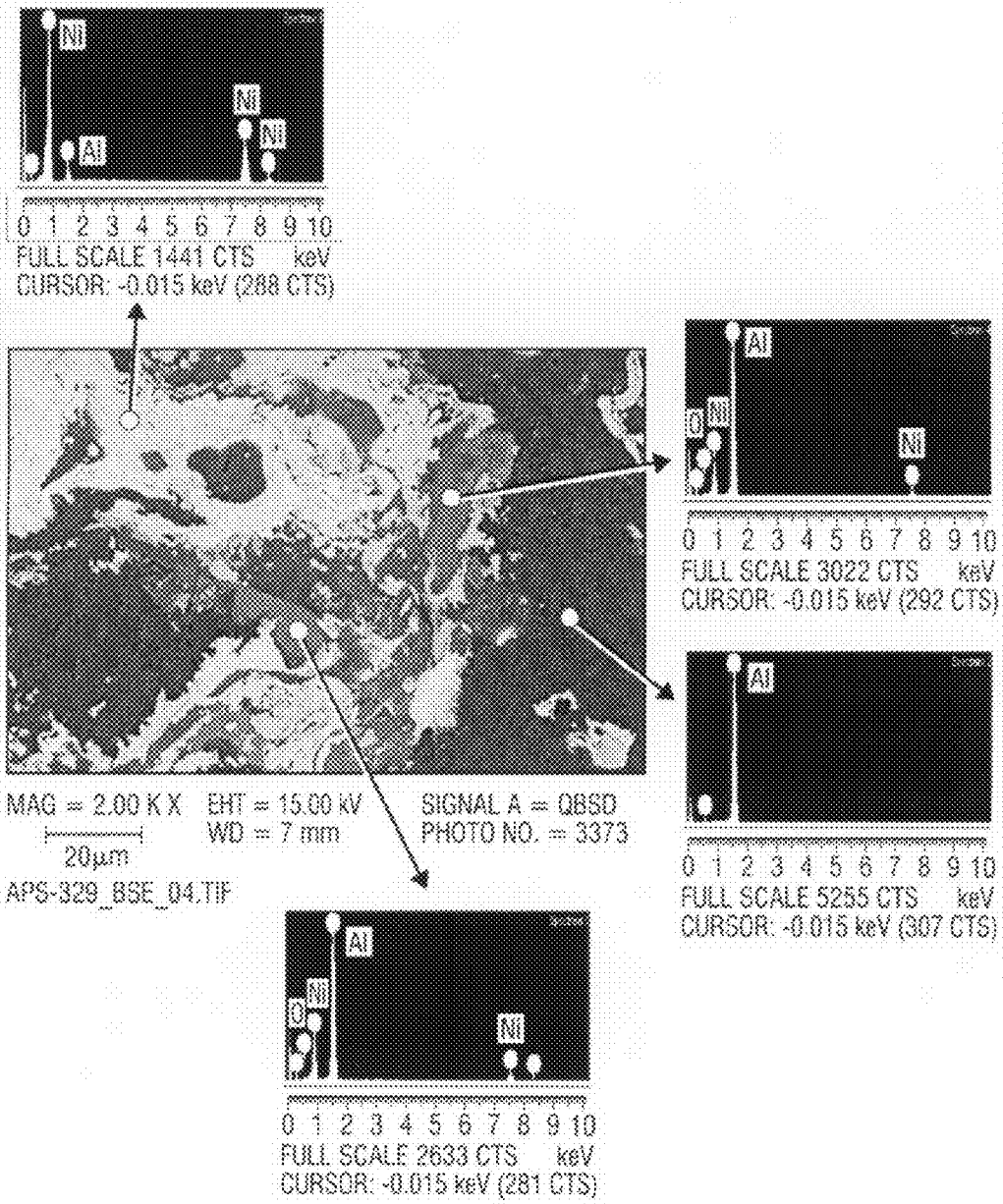
FIG. 14 is a back-scattered SEM image (2000×) and spot analyses by EDS for a low oxide content thermally sprayed metastable intermediary material comprising elemental Al, elemental Ni and relatively low amounts of NiO in accordance with an embodiment of the present invention.
Figure 15:
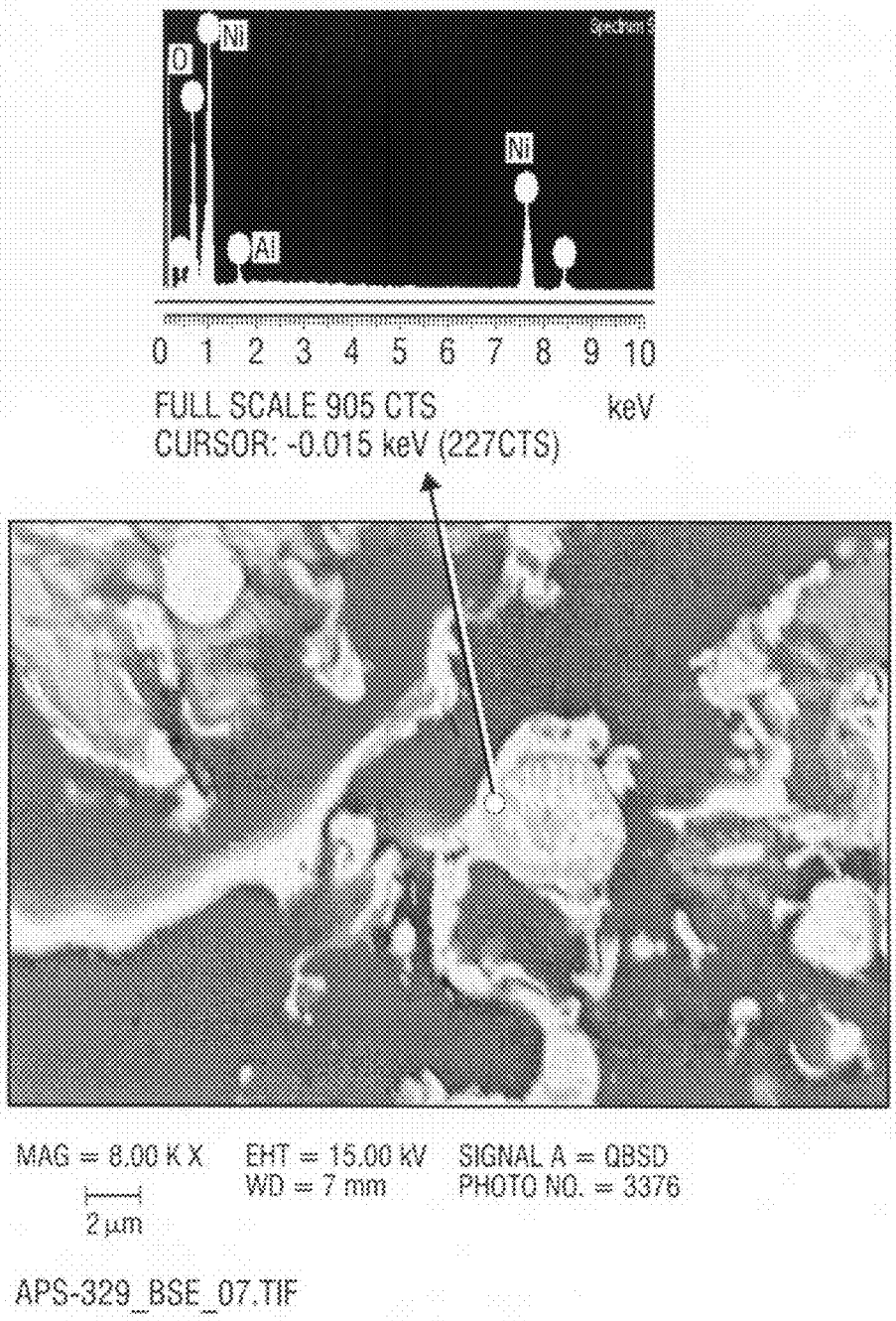
FIG. 15 is a back-scattered SEM image (5000×) and spot analysis by EDS for a low oxide content thermally sprayed metastable intermediary material comprising elemental Al, elemental Ni and relatively low amounts of NiO in accordance with an embodiment of the present invention.

Example 4 is a reactive composite with a lower oxide content than is present in Example 2. The XRD spectrum obtained from this composite, FIG. 12, shows that it is primarily composed of elemental Ni and Al with a much smaller relative concentration of nickel oxide (NiO). This compositional analysis is further supported by the SEM/EDS analysis presented in FIGS. 13-15. These images show that a much smaller volume fraction of the elemental Ni was converted to NiO during the deposition process than was converted in creating the reactive precursor presented as Example 2.

Example 5

$Ni_xAl_y$ Alloy Made from Low Oxide Content Precursor

Figure 16:
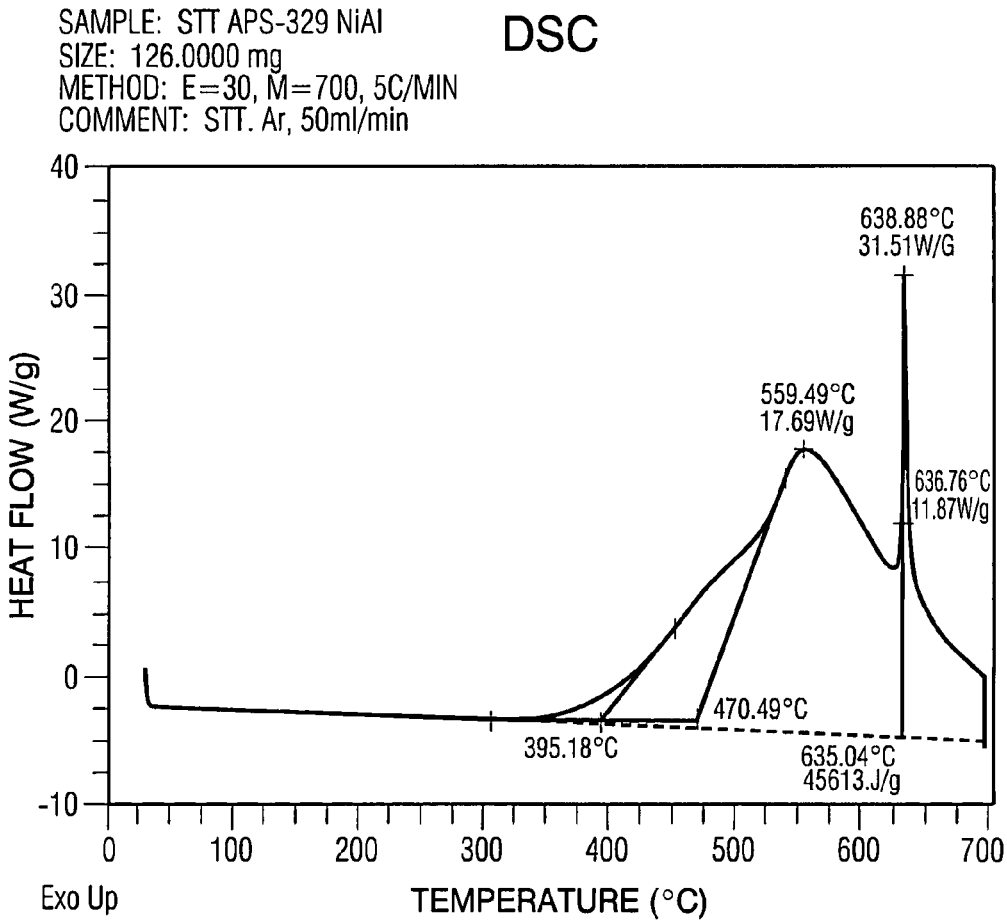
FIG. 16 is a DSC trace of an exothermic reaction that occurs upon heating of a low oxide content thermally sprayed metastable intermediary material comprising elemental Al, elemental Ni and relatively low amounts of NiO in accordance with an embodiment of the present invention.
Figure 17:
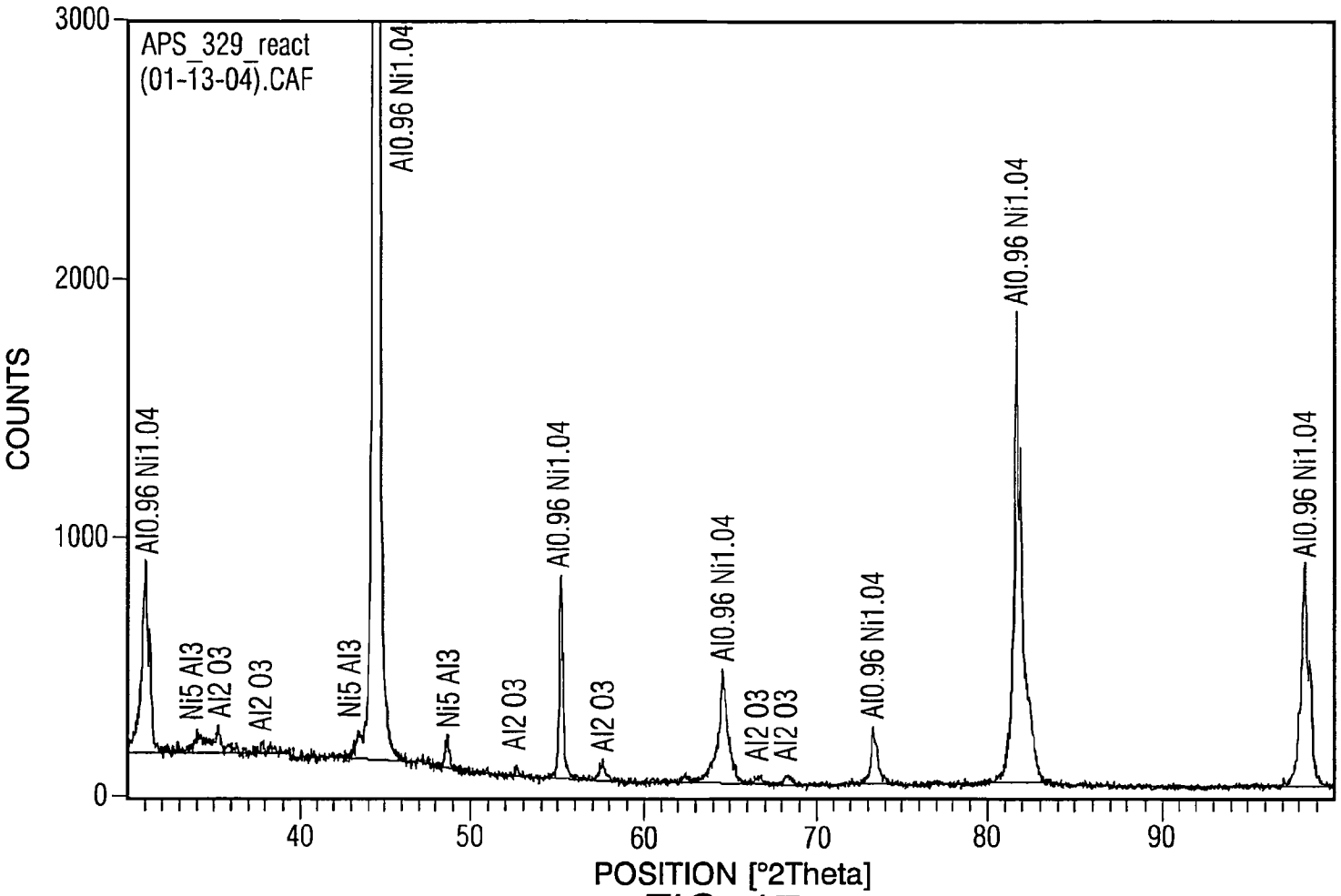
FIG. 17 shows XRD data for NiAl corresponding to the reaction product of the low oxide content intermediary material.

When the reactive intermediary of Example 4 is heated it releases energy as depicted by the DSC trace in FIG. 16. Less thermal energy is released by this reaction than was released by the reaction exhibited by the reactive composite presented as Example 2. Example 5 is a nickel alumide alloy formed by initiating a reaction the low oxide content composite. The XRD pattern obtained from this sample, FIG. 17, shows that reflections of the initial aluminum, nickel, and NiO phases are absent. This indicates that these phases are consumed in the reaction. However, because there is not a high concentration of NiO present in the precursor composite it reacts through a cooler SHS reaction mechanism without a great deal of thermal energy being contributed from a complimentary thermite reaction.

Figure 18:
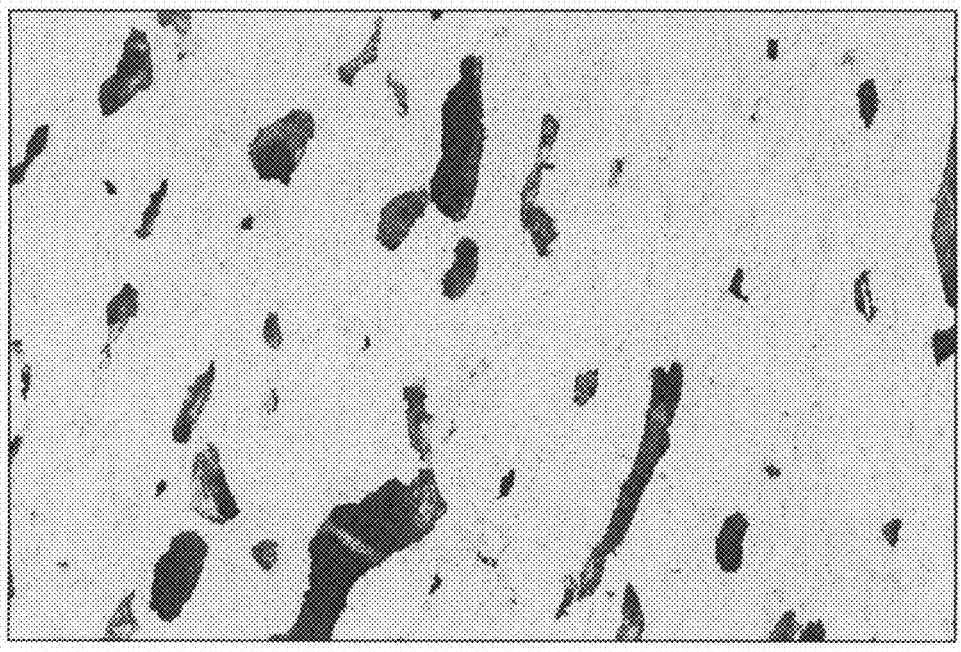
FIG. 18 is a back-scattered SEM image (200×) for NiAl corresponding to the reaction product of the low oxide content intermediary material.
Figure 19:
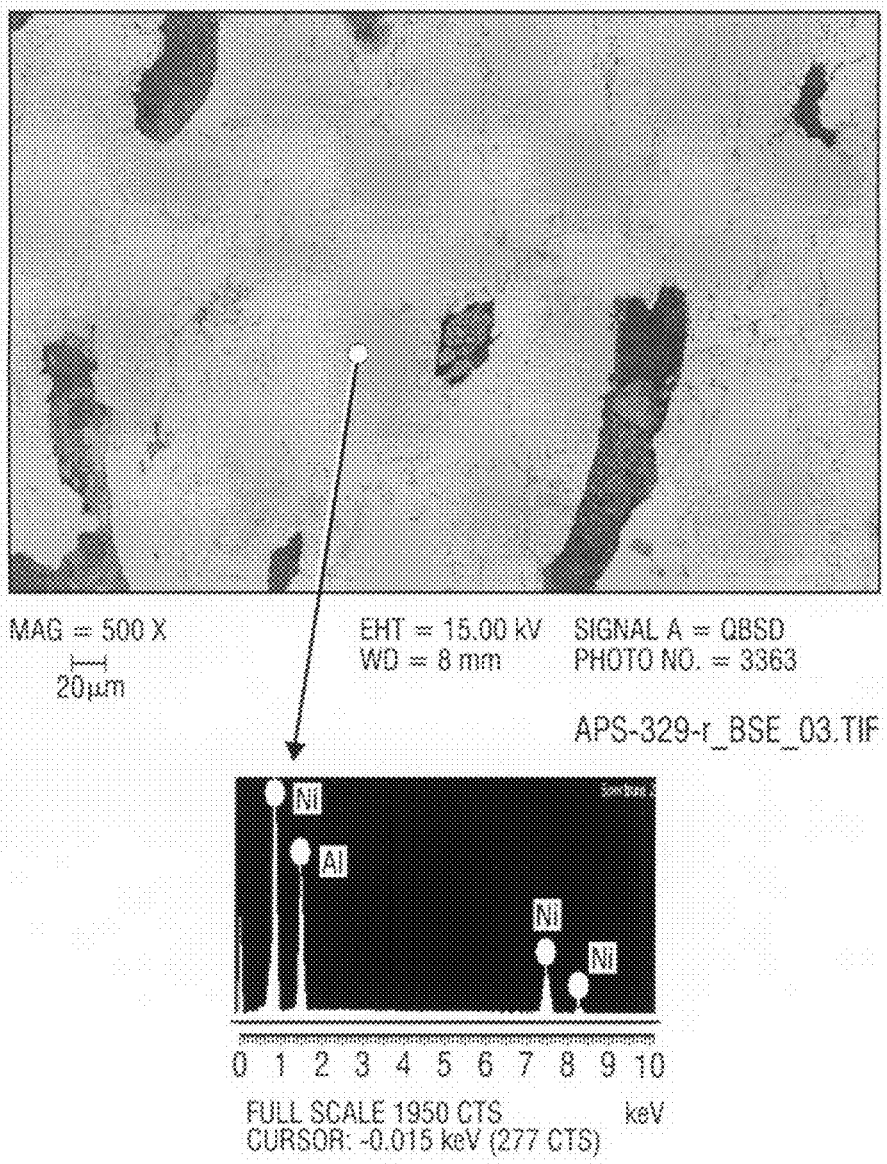
FIG. 19 is a back-scattered SEM image (500×) and EDS spot analysis for NiAl corresponding to the reaction product of the low oxide content intermediary material.
Figure 20:
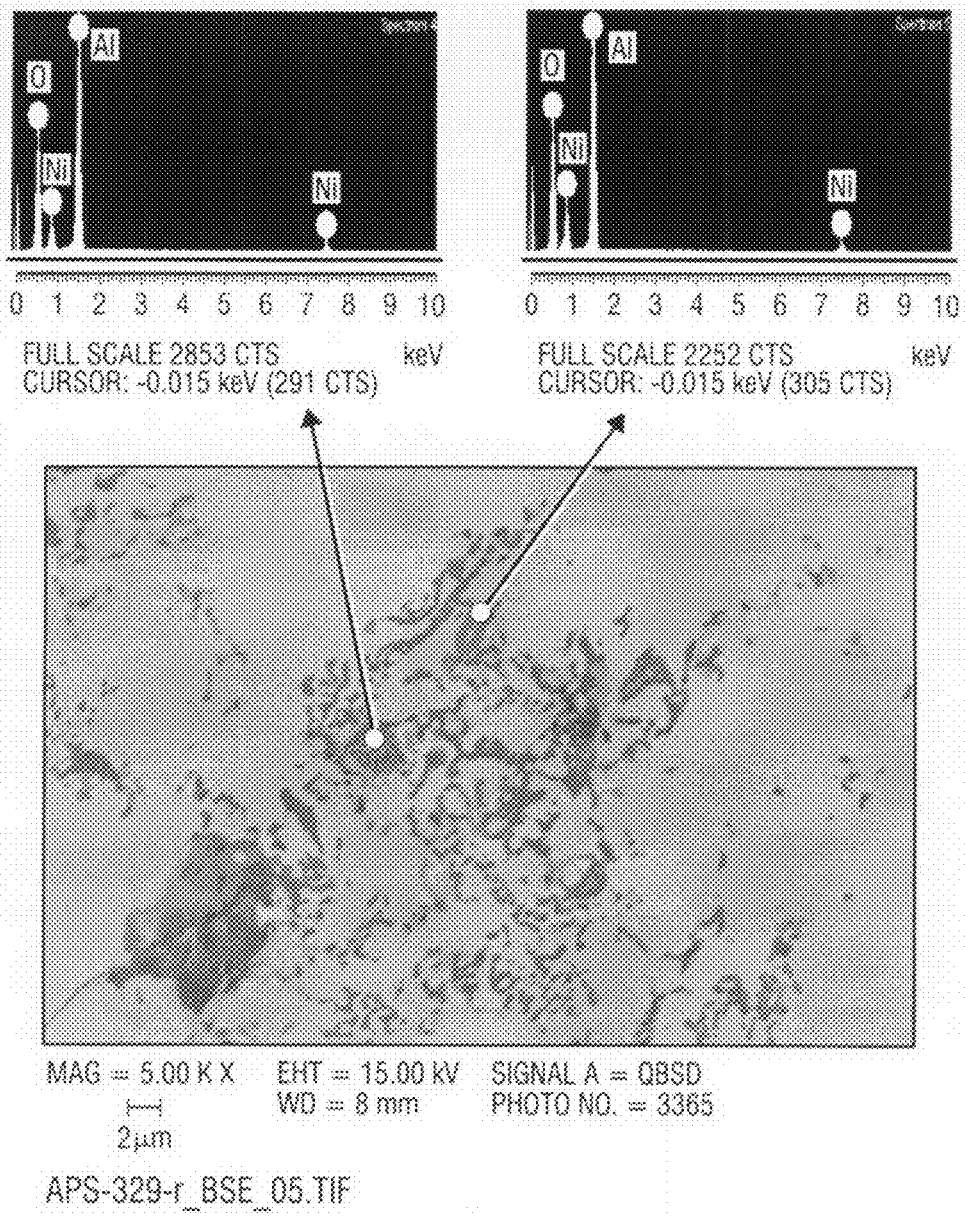
FIG. 20 is a back-scattered SEM image (5000×) and EDS spot analysis for NiAl corresponding to the reaction product of the low oxide content intermediary material.
Figure 21:
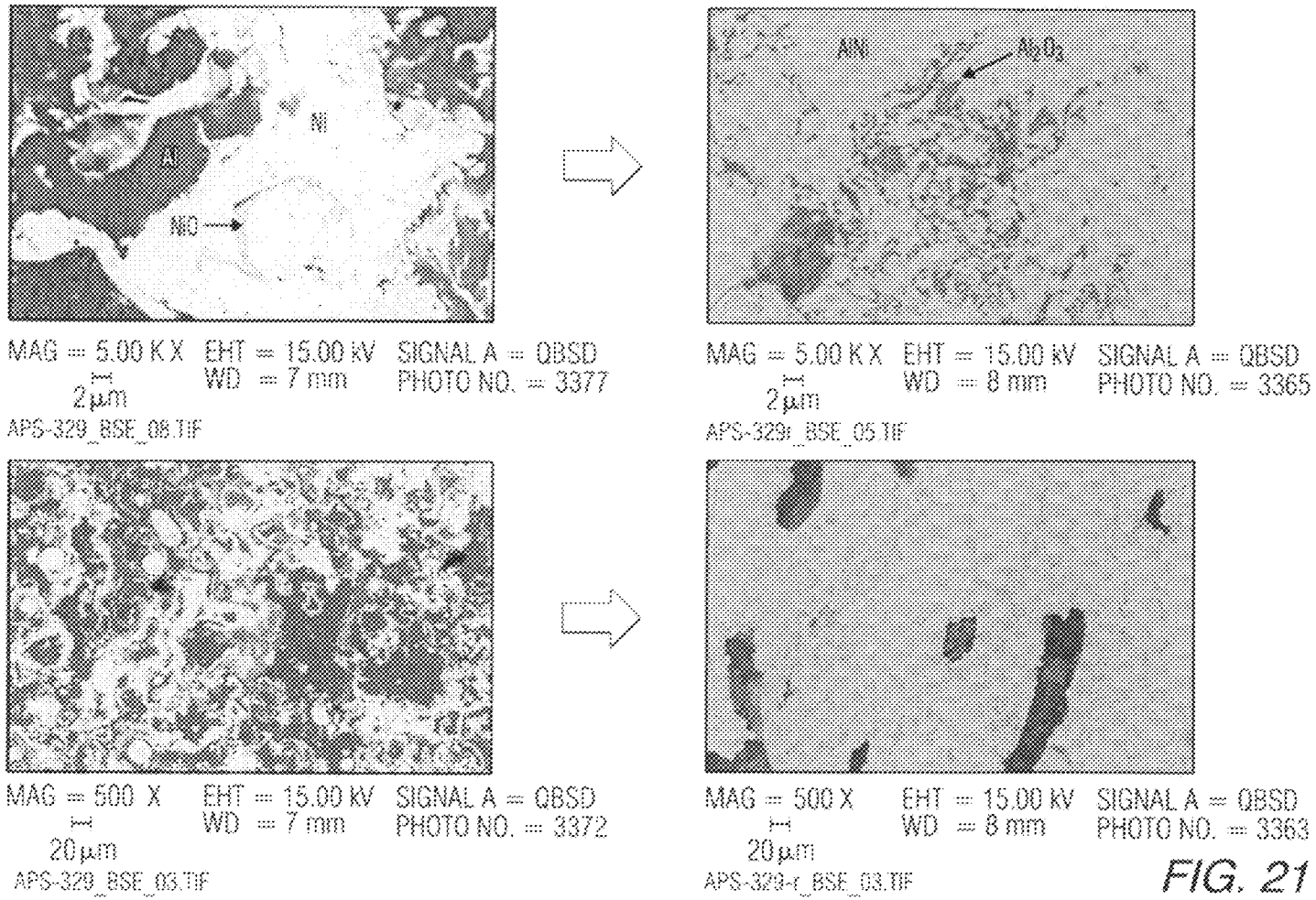
FIG. 21 shows back-scattered SEM images of the as-sprayed (left) and reacted (right) low oxide content intermediary material at high magnification (top) and low magnification (bottom).

As a result, the material never achieves a fully molten state and retains a number of microstructural similarities to its precursor composite. The BSE-SEM image presented in FIG. 18 is dominated by a monotone light grey field interspersed by a high amount of porosity and small veins of a darker grey shaded phase. The porosity resides along the interlamellar boundaries present in the precursor composite. Based on the supporting EDS shown in FIG. 19 and FIG. 20, the dominant phase is the AlNi phase identified by XRD and the darker grey phase is attributed to $Al_2O_3$. These results are consistent with the XRD, indicating complete consumption of the initial Al, Ni, and NiO. However, the exothermic reaction was not as energetic as the reaction which occurred in the high oxide content sample. FIG. 21 depicts the microstructural changes that occur when the material undergoes it self-sustaining reaction.

Example 6

Metastable Intermediary Material with Negligible Oxide Content

Figure 22:
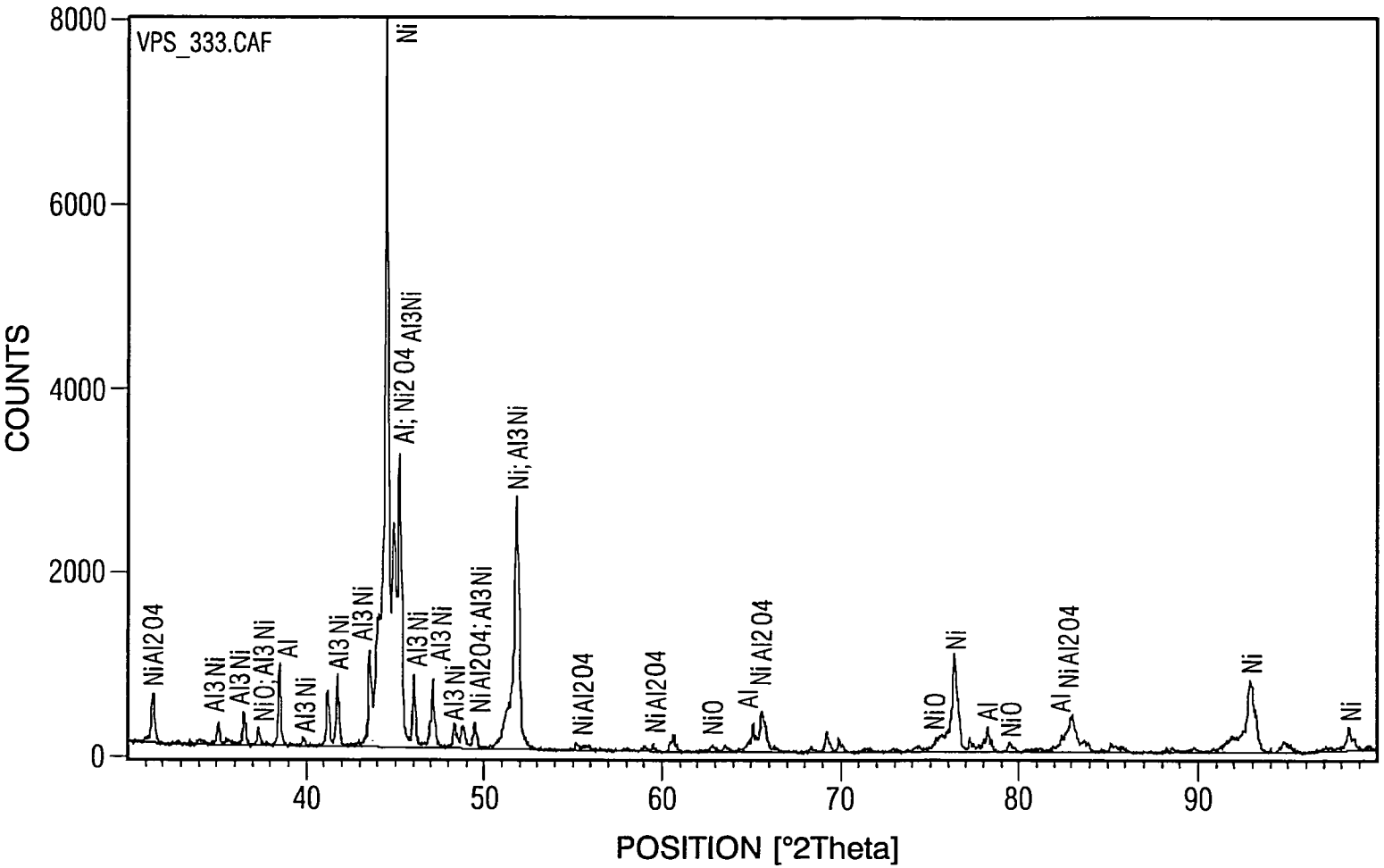
FIG. 22 shows XRD data for a thermally sprayed intermediary material formed in a reduced pressure and reduced oxygen environment in accordance with an embodiment of the present invention.
Figure 23:
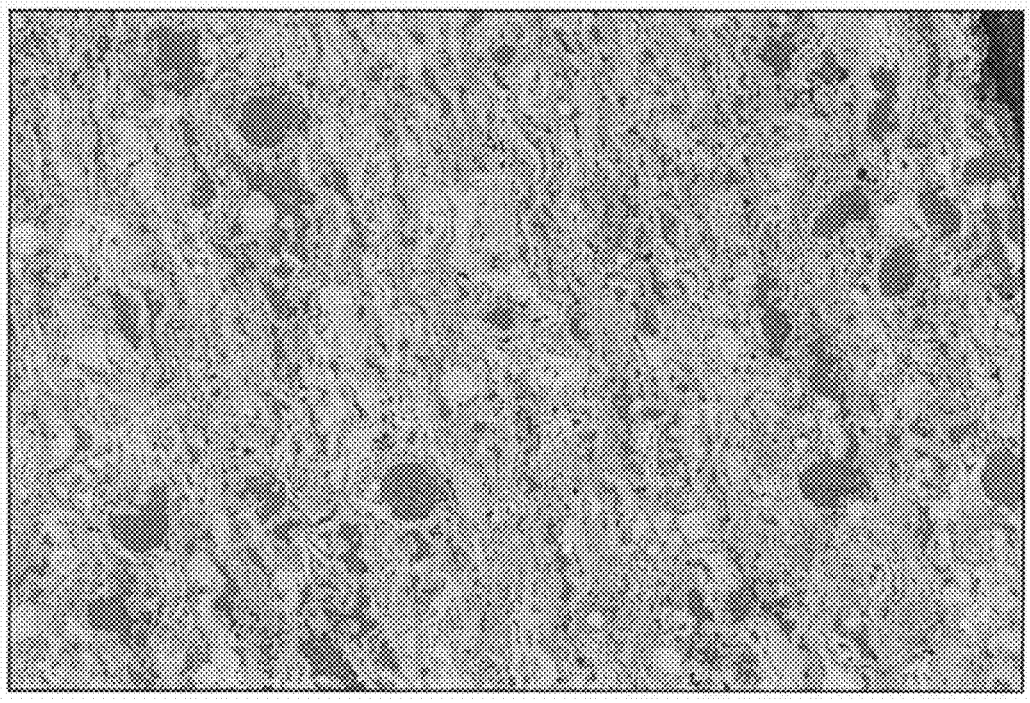
FIG. 23 is a back-scattered SEM image (200×) of a thermally sprayed intermediary material formed in a reduced pressure and reduced oxygen environment in accordance with an embodiment of the present invention.
Figure 24:
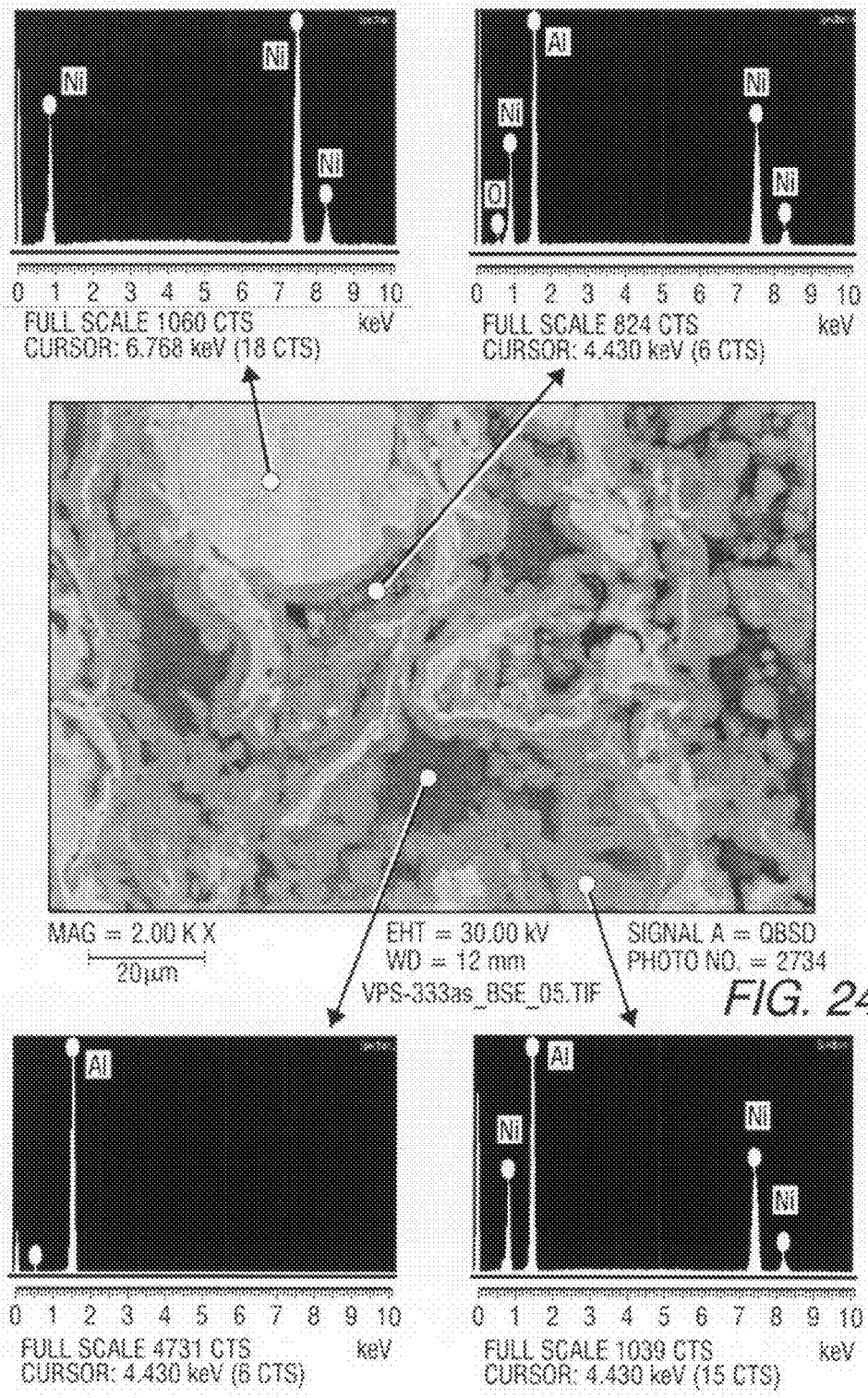
FIG. 24 is a back-scattered SEM image (2000×) and spot analyses by EDS for a thermally sprayed intermediary material formed in a reduced pressure and reduced oxygen environment in accordance with an embodiment of the present invention.

Example 6 is a reactive composite material that was produced in a reduced pressure, reduced oxygen content environment. The main phases identified by XRD are aluminum, nickel and the intermetallic phase $Al_3Ni$, FIG. 22. Some weaker reflections indicate the presence of the oxide phases NiO and $NiAl_2O_4$. The distribution of these phases was observed using SEM/EDS. At 200× it is evident that the material consists of spheres and veins of pure nickel (appearing near white in the micrograph), mainly spheres and particles of pure aluminum (appearing dark grey), intermixed with the intermetallic $Al_3Ni$ phase (appearing grey), FIG. 23. The largest nickel spheres are approximately 50 μm in diameter; the largest aluminum spheres/particles are larger, ~75-100 μm. At a higher magnification, EDS spot analysis was used to identify the pure nickel, pure aluminum, and intermetallic phases, FIG. 24. However, even at this magnification NiO phases were indiscernible. This phase is therefore considered to be present only in negligible amounts.

Example 7

$Ni_xAl_y$ Alloy Made from Precursor with Negligible Oxide Content

Figure 25:
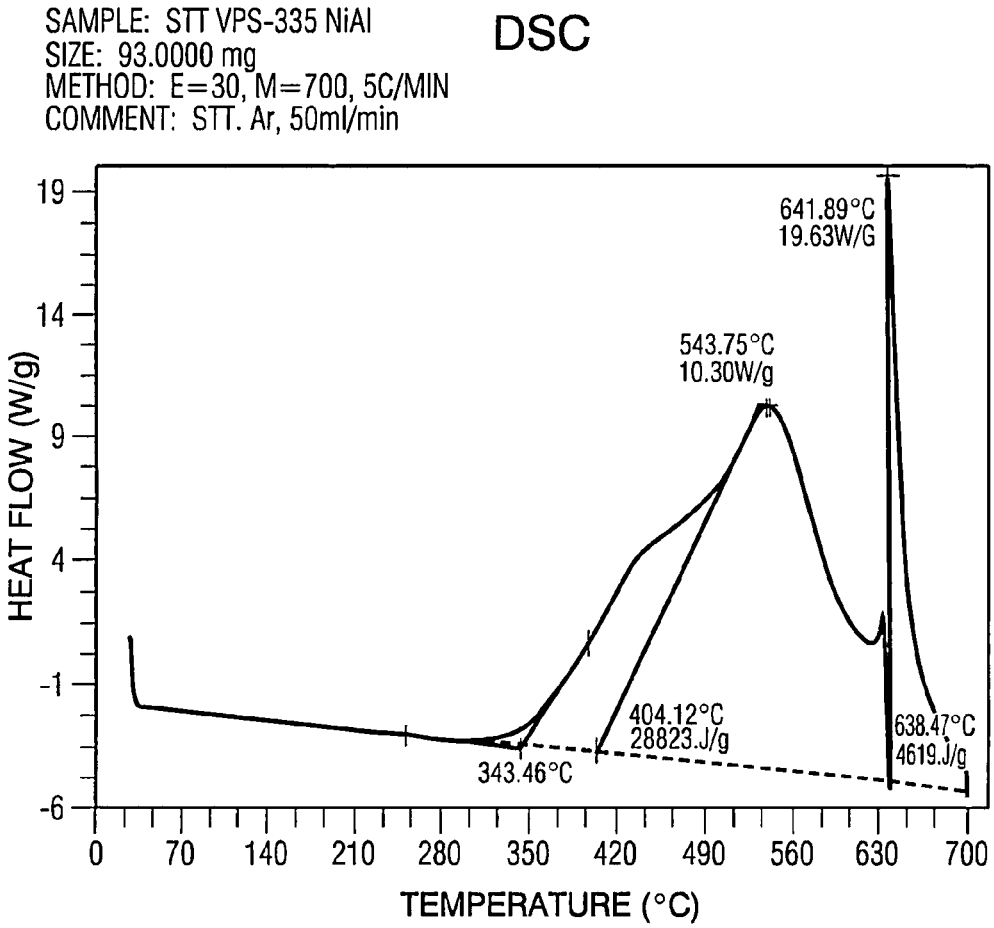
FIG. 25 is a DSC trace of an exothermic reaction that occurs upon heating of a thermally sprayed intermediary material produced in a reduced pressure low oxygen environment in accordance with an embodiment of the present invention.

The DSC trace obtained for the reaction of the negligible oxide content precursor of Example 6 shows that it is more susceptible to diffusion reactions than the previous precursors, FIG. 25. This means that the total energy put out by this reaction will be spread out over a longer span of time. Furthermore, the reaction releases less total energy. These two factors prevent the material from fully melting and allow it to retain its shape and some of its microstructural features.

Figure 26:
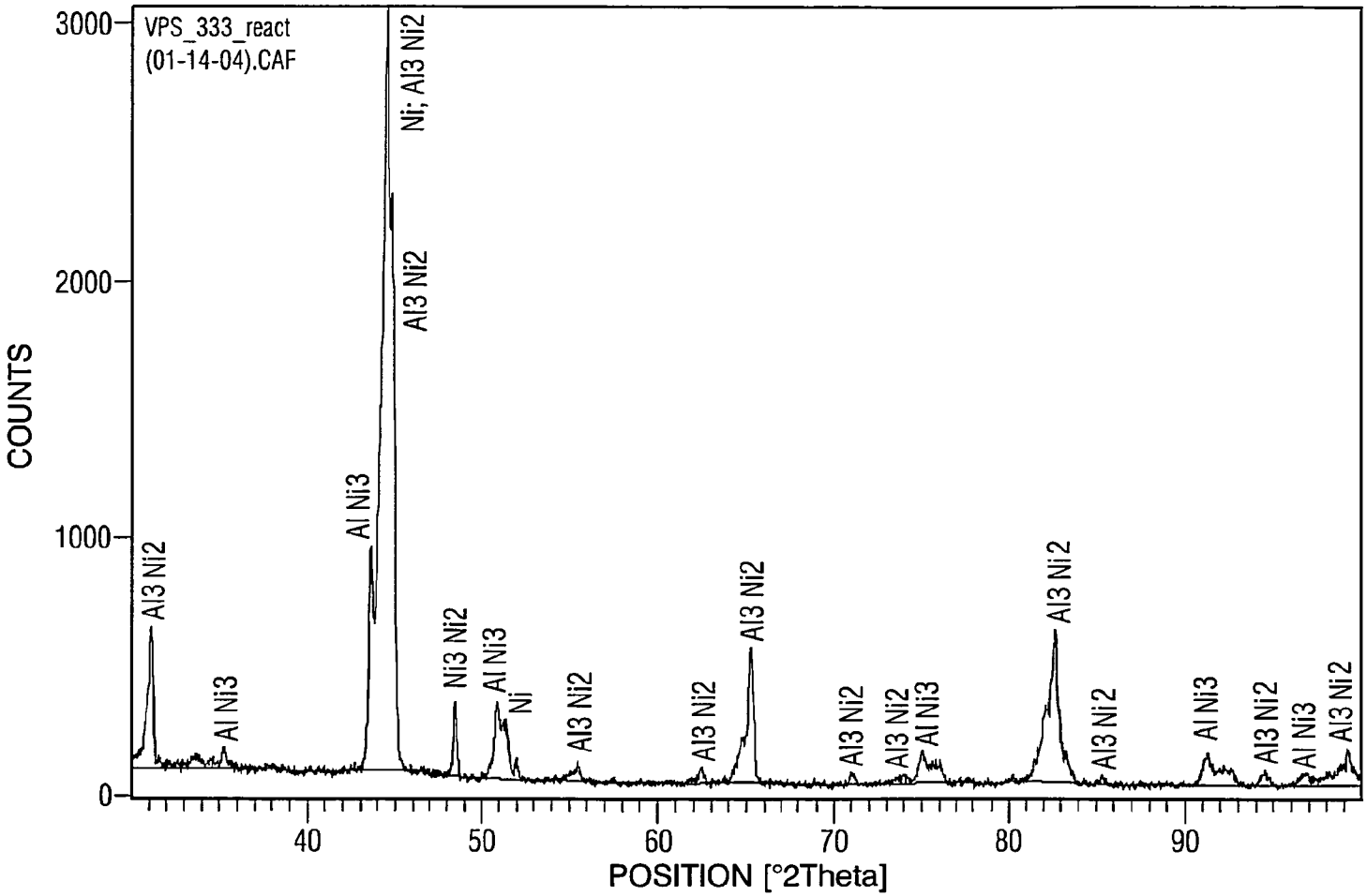
FIG. 26 shows XRD data for $Ni_xAl_y$ corresponding to the reaction product of the intermediary material formed in a reduced pressure and reduced oxygen environment.

Reflections of the initial aluminum and $Al_3Ni$ phases are absent in the XRD pattern of this alloy, FIG. 26. This indicates that these phases are consumed in the reaction. In addition, there is only weak evidence that elemental Ni is still present. However, several intermetallic $Ni_xAl_y$ phases are observed ($Al_3Ni_2$ and $AlNi_3$). Possible matches can be made to several other Al—Ni alloys which have diffraction patterns similar to $Al_3Ni_2$ but differ in stoichiometry (~40 at % Al—60 at % Al). The major phase identifications are labeled in FIG. 26. No evidence of oxide phases are found in the XRD data.

Figure 27:
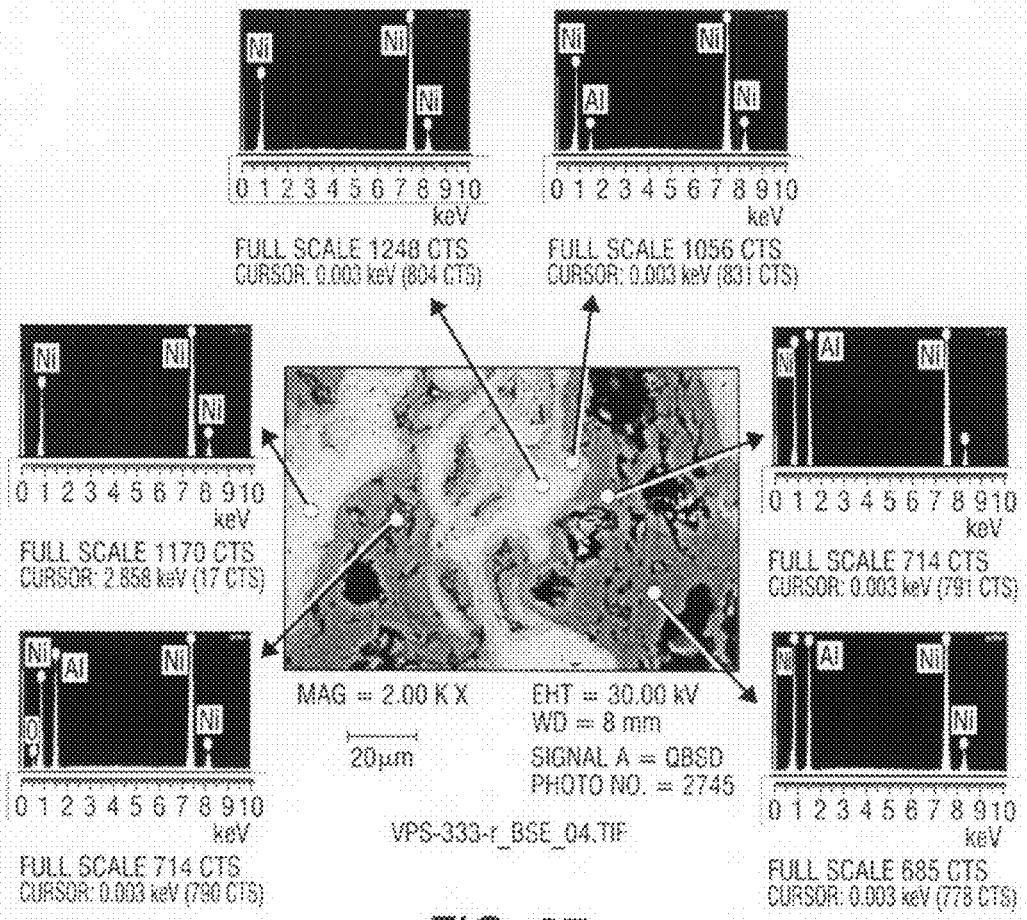
FIG. 27 shows back-scattered SEM image (2000×) and spot analyses by EDS for $Ni_xAl_y$ corresponding to the reaction product of the intermediary material in a reduced pressure and reduced oxygen environment.
Figure 28:
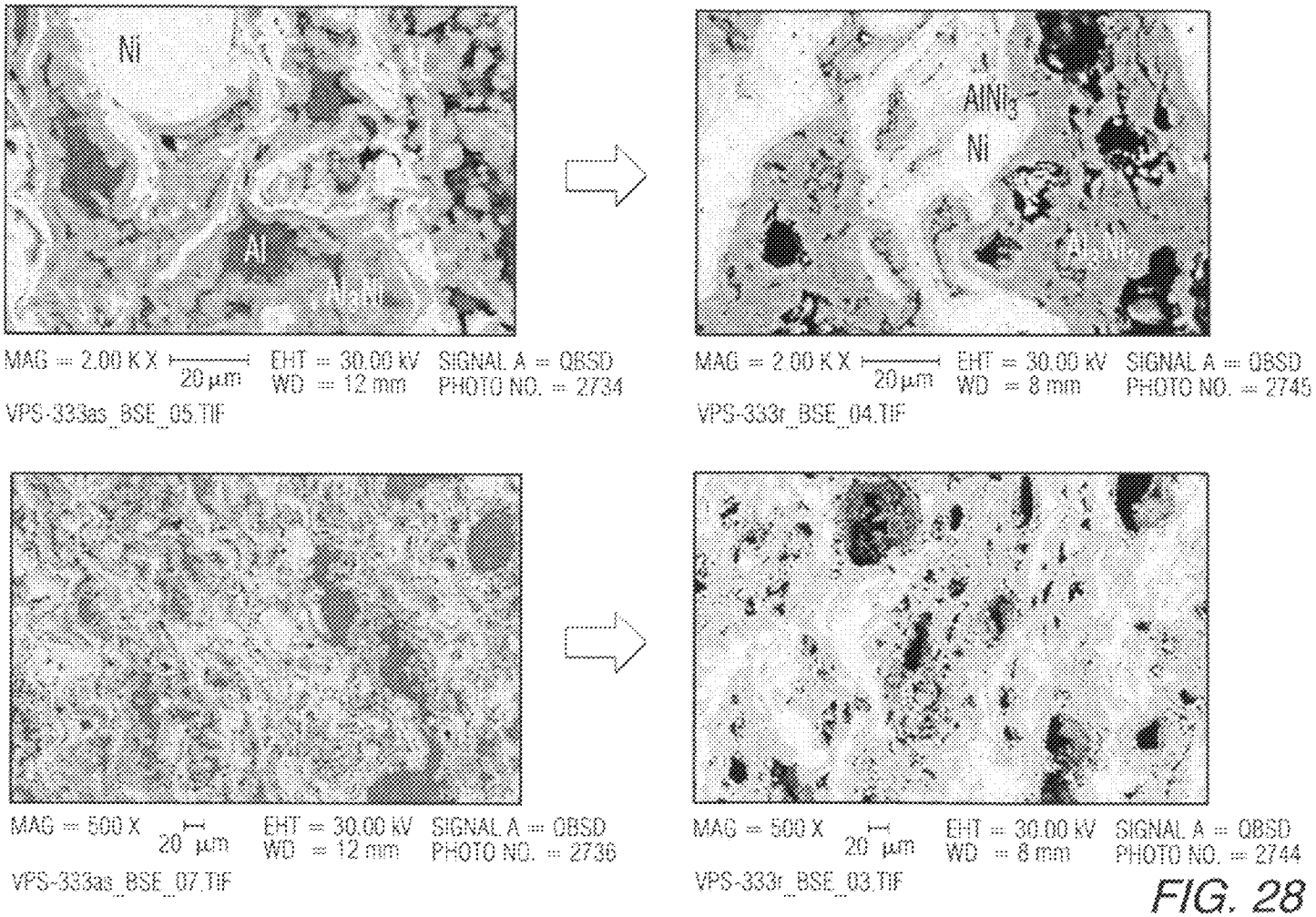
FIG. 28 shows back-scattered SEM images of the as-sprayed (left) and reacted (right) intermediary material formed in a reduced pressure and reduced oxygen environment $Ni_xAl_y$ at high magnification (top) and low magnification (bottom).

The BSE-SEM and EDS analysis confirms that no regions of pure Al are present in this material, FIG. 27. However, EDS spot analysis determined that the near-white regions in the SEM image are pure nickel despite the fact that the XRD results show only very weak reflections for this phase. The major phase has a medium-dark grey shade in the images and is identified as the $Al_3Ni_2$ intermetallic phase. In the regions between the $Al_3Ni_2$ and Ni phases, intermediate regions light-medium grey can be distinguished. EDS verifies these to be a nickel-rich Al—Ni component, and the assignment is therefore made to the $AlNi_3$ phase observed in the XRD data.

The effect that introducing $Al_2O_3$ into the microstructure had on the strength of the coatings was evaluated using a Vickers microhardness test. In the test, a 1 kg load was applied for 12 seconds. The lengths of the diagonals of the resulting indent were then measured and used to calculate hardness numbers. In this test, higher Vickers hardness numbers indicate harder materials.

TABLE 1

Hardness vs. Oxide Content

| Formation Process Used | Relative Oxide Content in Precursor | Vickers Hardness (1 kgf) |
|---|---|---|
| Examples 2 and 3 | High Oxide | 492 |
| Examples 4 and 5 | Moderate Oxide | 398 |
| Examples 6 and 7 | Negligible Oxide | 232 |

The results show that hardness increases as oxide content increases in the reactive precursor material. This is a result of a dispersion of $Al_2O_3$ particles that appear in the NiAl material after the reaction.

Whereas particular embodiments of this invention has been described above for purposes of illustration, it will be evident to those skilled in the art that numerous variations of the details of the present invention may be made without departing from the invention as defined in the appended claims.

The invention claimed is:

1. A method of making a reactive material comprising thermally spraying individual powders of a precursor metal and aluminum in the presence of oxygen to partially oxidize the precursor metal in flight and to produce a reactive intermediary material comprising the precursor metal, an oxide of the precursor metal, and the aluminum.

2. The method of claim 1, wherein the oxide of the precursor metal forms a surface layer on the precursor metal.

3. The method of claim 1, wherein the precursor metal comprises Ni, Cu, Ti, Fe and/or W.

4. The method of claim 1, wherein the precursor metal comprises Ni and the oxide of the precursor metal comprises NiO.

5. The method of claim 4, wherein the NiO forms a surface layer on the Ni precursor metal.

6. The method of claim 1, wherein the thermal spraying is performed in an oxygen-containing atmosphere.

7. The method of claim 1, wherein the thermal spraying is performed at atmospheric pressure.

8. The method of claim 1, wherein the thermal spraying is performed below atmospheric pressure.

9. The method of claim 6, wherein the thermal spraying is performed in air at atmospheric pressure.

10. The method of claim 6, wherein the thermal spraying is performed in air below atmospheric pressure.

11. A method of making a metal aluminide material comprising:

thermally spraying precursor metal and aluminum in the presence of oxygen to produce a reactive intermediary material comprising the precursor metal, an oxide of the precursor metal, and aluminum; and initiating a reaction of the reactive intermediary material to react the precursor metal and the aluminum together to form the metal aluminide material.

12. The method of claim 11, wherein the precursor metal comprises Ni, Cu, Ti, Fe and/or W.

13. The method of claim 11, wherein the precursor metal comprises Ni and the oxide of the precursor metal comprises NiO.

14. The method of claim 13, wherein the NiO forms a surface layer on the Ni precursor metal.

15. The method of claim 11, wherein the precursor metal and aluminum are provided in the form of powders.

16. The method of claim 11, wherein the thermal spraying is performed in an oxygen-containing atmosphere.

17. The method of claim 11, wherein the thermal spraying is performed in air.

18. The method of claim 11, wherein the thermal spraying is performed at atmospheric pressure.

19. The method of claim 11, wherein the thermal spraying is performed below atmospheric pressure.

20. The method of claim 11, wherein the reaction of the intermediary material is initiated by heating the reactive intermediary material.

21. The method of claim 20, wherein the heating comprises localized heating of a portion of the intermediary material.

22. The method of claim 20, wherein the heating comprises bulk heating of the reactive intermediary material.

23. The method of claim 20, wherein the reactive intermediary material is at ambient temperature prior to the initiation of the reaction.

24. The method of claim 20, wherein the reactive intermediary material is cooled to substantially room temperature prior to the initiation of the reaction.

25. The method of claim 11, wherein the metal aluminide material comprises strengthening precipitates.

26. The method of claim 11, wherein the metal aluminide material has a density of at least about 99 percent of theoretical density.

27. A method of making a metal aluminide material comprising heating a reactive intermediary material comprising:

thermally sprayed elemental aluminum;

at least one other elemental metal; and an oxide of the at least one other elemental metal, to initiate an exothermic reaction of the reactive intermediary material which forms the metal aluminide material, wherein the metal aluminide material comprises a matrix with $Al_2O_3$ precipitates dispersed therein.

28. The method of claim 27, wherein the elemental metal comprises Ni.

29. The method of claim 28, wherein the oxide of the elemental metal comprises NiO which forms a surface layer on the Ni.

30. The method of claim 1, wherein the individual powders of the precursor metal and aluminum are mixed together prior to the thermal spraying step.

31. The method of claim 4, wherein the Ni precursor metal and the aluminum are provided in substantially stoichiometrically equal amounts.

* * * * *